US009406263B2

(12) United States Patent
Huang et al.

(10) Patent No.: US 9,406,263 B2
(45) Date of Patent: Aug. 2, 2016

(54) METHOD AND APPARATUS FOR CONTROLLING A BACKLIGHT BRIGHTNESS ACCORDING TO AVERAGE GRAYSCALES

(71) Applicants: Hisense Electric Co., Ltd, Qingdao, Shandong (CN); HISENSE USA CORPORATION, Suwanee, GA (US)

(72) Inventors: Shunming Huang, Qingdao (CN); Yuxin Zhang, Qingdao (CN); Jia Yang, Qingdao (CN); Jie Yang, Qingdao (CN)

(73) Assignees: Hisense Electric Co., Ltd, Qingdao (CN); HISENSE USA CORPORATION, Suwanee, GA (US)

( * ) Notice: Subject to any disclaimer, the term of this patent is extended or adjusted under 35 U.S.C. 154(b) by 53 days.

(21) Appl. No.: 14/325,046

(22) Filed: Jul. 7, 2014

(65) Prior Publication Data

US 2015/0371594 A1 Dec. 24, 2015

(30) Foreign Application Priority Data

Jun. 20, 2014 (CN) ..... 2014 1 0279785

(51) Int. Cl.
*G09G 5/00* (2006.01)
*G09G 3/34* (2006.01)
*G09G 3/00* (2006.01)

(52) U.S. Cl.
CPC ..... *G09G 3/3426* (2013.01); *G09G 3/003* (2013.01); *G09G 2320/0209* (2013.01); *G09G 2320/062* (2013.01); *G09G 2320/0646* (2013.01); *G09G 2320/0653* (2013.01); *G09G 2360/145* (2013.01)

(58) Field of Classification Search
USPC ..... 345/6
See application file for complete search history.

(56) References Cited

U.S. PATENT DOCUMENTS

2011/0037829 A1* 2/2011 Hata ..... H04N 13/0025 348/43
2012/0019524 A1* 1/2012 Nobori ..... H04N 13/0427 345/419
2012/0212487 A1* 8/2012 Basler ..... G09G 3/3413 345/419

* cited by examiner

*Primary Examiner* — Long D Pham
(74) *Attorney, Agent, or Firm* — Knobbe Martens Olson & Bear LLP

(57) ABSTRACT

A method of processing a display signal includes: obtaining the average of grayscales of at least one display zone in a previous frame of image and a current frame of image respectively; comparing in magnitude the average of grayscales of at least one display zone in the current frame of image with the average of grayscales of the corresponding display zone in the previous frame of image; and outputting a backlight control value to increase or reduce the brightness of an illuminating element corresponding to the display zone when the average of grayscales of the at least one display zone in the current frame of image is larger or smaller than the average of grayscales of the corresponding display zone in the previous frame of image.

20 Claims, 10 Drawing Sheets

| | The average of grayscales in the current frame of image | | | | | | | | | |
|---|---|---|---|---|---|---|---|---|---|---|
| The average of grayscales in the previous frame of image | | 0 | 8 | 16 | ... | ... | N | ... | ... | 255 |
| | 0 | 20% | 21% | | | | | | | 25% |
| | 8 | 18% | 20% | 21% | | | | | | |
| | 16 | | 18% | 20% | 21% | | | | | |
| | ... | | | 18% | 20% | 21% | | | | |
| | ... | | | | 18% | 20% | 21% | | | |
| | N | | | | | 19% | 20% | 21% | | |
| | ... | | | | | | 18% | 20% | 21% | |
| | ... | | | | | | | 18% | 20% | 20% |
| | 255 | 1% | | | | | | | 18% | 20% |

Fig.8

| | The average of grayscales in the current frame of image | | | | | | | | | |
|---|---|---|---|---|---|---|---|---|---|---|
| The average of grayscales in the previous frame of image | | 0 | 8 | 16 | ... | ... | N | ... | ... | 255 |
| | 0 | 300mA | 305mA | | | | | | | 320mA |
| | 8 | 295mA | 300mA | 305mA | | | | | | |
| | 16 | | 295mA | 300mA | 305mA | | | | | |
| | ... | | | 295mA | 300mA | 305mA | | | | |
| | ... | | | | 295mA | 300mA | 305mA | | | |
| | N | | | | | 295mA | 300mA | 305mA | | |
| | ... | | | | | | 295mA | 300mA | 305mA | |
| | ... | | | | | | | 295mA | 300mA | 305mA |
| | 255 | 280mA | | | | | | | 295mA | 300mA |

Fig.9

| | The average of grayscales in the current frame of image | | | | | | | | | |
|---|---|---|---|---|---|---|---|---|---|---|
| The average of grayscales in the previous frame of image | | 0 | 8 | 16 | ... | ... | N | ... | ... | 255 |
| | 0 | 10% | 12% | | | | | | | 25% |
| | 8 | 9% | 11% | 13% | | | | | | |
| | 16 | | 10% | 12% | 14% | | | | | |
| | ... | | | 11% | 13% | 15% | | | | |
| | ... | | | | 12% | 14% | 16% | | | |
| | N | | | | | 13% | 15% | 17% | | |
| | ... | | | | | | 14% | 16% | 16% | |
| | ... | | | | | | | 15% | 15% | 15% |
| | 255 | 1% | | | | | | | 14% | 14% |

METHOD AND APPARATUS FOR CONTROLLING A BACKLIGHT BRIGHTNESS ACCORDING TO AVERAGE GRAYSCALES

CROSS-REFERENCES TO RELATED APPLICATIONS

This application claims the benefit of Chinese Patent Application No. 201410279785.0, filed with the Chinese Patent Office on Jun. 20, 2014 and entitled "Method of and apparatus for processing display signal and display device", which is hereby incorporated by reference in its entirety.

FIELD

The present application relates to the field of display technologies and particularly to a method of and apparatus for processing a display signal and a display device.

BACKGROUND

In the technology of shutter glass 3D which is one of glass 3D display technologies, a pair of active LCD alternate shutter glasses are used so that a left-eye image is seen in a time-division manner by the left eye of a user, and a right-eye image is seen in the time-division manner by the user's right eye, where the two left-eye and right-eye images with a parallax as received in the time-division manner by the left and right eyes are integrated together in the brain for the purpose of 3D display. The left-eye image and the right-eye image are displayed in the time-division manner by a liquid crystal screen at a frequency of 120 Hz or higher, and liquid crystals are driven normally for display, and due to some response time with the deflection of liquid crystal molecules or the like, there is some delay in grayscale conversion between the left-eye image and the right-eye image displayed in the time-division manner, and the shutter 3D display technology may suffer from the problem of a crosstalk ghost, thus degrading a visual effect.

In order to address the problem above so as to improve the rate at which the liquid crystal molecules are deflected, the scheme of Over Drive (OD) has been to shorten the response time of liquid crystals and thus alleviate the crosstalk ghost in 3D. Particularly since the rate and the angle at which the liquid crystal molecules are converted and twisted are decided by the magnitude of an applied voltage, the response time of the liquid crystals can be shortened and thus the problem of a crosstalk ghost can be alleviated by raising the voltage. For example, given the same pixel, if there are a grayscale of 200 for the left eye and a grayscale of 16 for the right eye, then in order to shorten the response time of the liquid crystals, a voltage corresponding to a grayscale of 10 is output by a drive Integrated Circuit (IC) to data lines to thereby shorten the response time of the liquid crystals and reduce the delay between the left and right images so as to improve the 3D display effect. However as to a relatively white pixel (e.g., at a grayscale above 200) and a relatively black pixel (e.g., at a grayscale below 32), a increase in voltage may result in an insignificant influence upon the response time of the liquid crystals and a low variation in brightness, that is, there may be an inconsiderable OD effect at a relatively high grayscale or a relatively low grayscale, thus failing to alleviate a crosstalk ghost in a 3D display picture and degrading the display effect.

SUMMARY

A method of processing a display signal, wherein the method is applicable to a 3D display device, and the method includes:

obtaining the average of grayscales of at least one display zone in a previous frame of image and the average of grayscales of at least one display zone in a current frame of image, wherein a frame of image is divided into a plurality of display zones, and each one of the plurality of display zones includes at least one pixel; and wherein the previous frame of image and the current frame of image are a left-eye image and a right-eye image respectively;

comparing in magnitude the average of grayscales of at least one display zone in the current frame of image with the average of grayscales of the corresponding display zone in the previous frame of image; and outputting a backlight control value to increase the brightness of an illuminating element corresponding to the display zone when the average of grayscales of the at least one display zone in the current frame of image is larger than the average of grayscales of the corresponding display zone in the previous frame of image, and outputting a backlight control value to reduce the brightness of the illuminating element corresponding to the display zone when the average of grayscales of the at least one display zone in the current frame of image is smaller than the average of grayscales of the corresponding display zone in the previous frame of image.

An apparatus for processing a display signal, wherein the apparatus for processing a display signal is applicable to a 3D display device, including:

a memory; and one or more processors, wherein:

the memory is configured to store computer readable program codes, and the one or more processors execute the computer readable program codes to implement:

obtaining the average of grayscales of at least one display zone in a previous frame of image;

obtaining the average of grayscales of at least one display zone in a current frame of image, wherein a frame of image is divided into a plurality of display zones, and each one of the display zones includes at least one pixel; and wherein the previous frame of image and the current frame of image are a left-eye image and a right-eye image respectively;

comparing in magnitude the average of grayscales of the at least one display zone in the current frame of image with the average of grayscales of the corresponding display zone in the previous frame of image; and outputting a backlight control value to increase the brightness of an illuminating element corresponding to the display zone when the average of grayscales of the at least one display zone in the current frame of image is larger than the average of grayscales of the corresponding display zone in the previous frame of image and to output a backlight control value to reduce the brightness of the illuminating element corresponding to the display zone when the average of grayscales of the at least one display zone in the current frame of image is smaller than the average of grayscales of the corresponding display zone in the previous frame of image.

A display device, including illuminating elements, a memory; and one or more processors, wherein:

the memory is configured to store computer readable program codes, and the one or more processors execute the computer readable program codes to implement:

obtaining the average of grayscales of at least one display zone in a previous frame of image and the average of grayscales of at least one display zone in a current frame of image, wherein a frame of image is divided into a plurality of display zones, and each one of the plurality of display zones includes at least one pixel; and wherein the previous frame of image and the current frame of image are a left-eye image and a right-eye image respectively;

comparing in magnitude the average of grayscales of at least one display zone in the current frame of image with the average of grayscales of the corresponding display zone in the previous frame of image; and outputting a backlight control value to increase the brightness of an illuminating element corresponding to the display zone when the average of grayscales of the at least one display zone in the current frame of image is larger than the average of grayscales of the corresponding display zone in the previous frame of image, and outputting a backlight control value to reduce the brightness of the illuminating element corresponding to the display zone when the average of grayscales of the at least one display zone in the current frame of image is smaller than the average of grayscales of the corresponding display zone in the previous frame of image.

BRIEF DESCRIPTION OF THE DRAWINGS

In order to make the technical solutions in some embodiments more apparent, the drawings to be used in a description of the embodiments will be briefly introduced below, and apparently the drawings to be described below are merely illustrative of some of some embodiments, and those ordinarily skilled in the art can derive from these drawings other drawings. In the drawings:

FIG. 8 is a schematic diagram of a first search table according to some embodiments;

FIG. 9 is a schematic diagram of a second search table according to some embodiments;

DETAILED DESCRIPTION OF CERTAIN EMBODIMENTS

The technical solutions according to some embodiments will be described below clearly and fully with reference to the drawings in some embodiments. Apparently the described embodiments are only a part but all of some embodiments. Based upon some embodiments here, all other embodiments obtained by those ordinary skilled in the art without creative efforts shall be within the protection scope of the application.

It shall be noted that a formula of display brightness in a display panel in the course of displaying is as follows:

$$B=B_L*T_r=(D*B_{LA})*(n/255)^r,$$

Wherein B is the display brightness of a pixel, $B_L$ is the brightness of a backlight, $T_r$ is a transmittivity of the display panel, D is a duty ratio of the backlight, $B_{LA}$ is the brightness of the backlight in a preset reference circuit, n is a grayscale of an image, and r is a Gamma value of the image.

As depicted in the formula above, the display brightness B of the pixel is equal to the brightness $B_L$ of the backlight multiplied by the transmittivity $T_r$ of the display panel, where the brightness $B_L$ of the backlight is dependent upon the duty ratio D of the backlight and the brightness $B_{LA}$ of the backlight with the preset reference current. The transmittivity $T_r$ of the display panel is dependent upon driving of liquid crystals, and a 3D crosstalk is adjusted by OD, that is, the transmittivity of the display panel and thus the display brightness of the pixel are adjusted primary by adjusting driving of the liquid crystals. However with the 3D crosstalk being adjusted by OD, as to a relatively white pixel element (e.g., at a grayscale above 200) and a relatively black pixel element (e.g., at a grayscale below 32), a increase in voltage may result in an insignificant influence upon a response time of the liquid crystals and a low variation in brightness, that is, there may be an inconsiderable OD effect at a relatively high grayscale or a relatively low grayscale, thus failing to alleviate a crosstalk ghost in a picture and degrading a display effect Moreover an existing display displays an image typically at a grayscale ranging from 0 to 255, and in some embodiments, a detailed description has been given taking a display grayscale interval of 0 to 255 including 256 display grayscale values as an example. Of course the display can alternatively display an image in a defined grayscale interval or at defined grayscale values, for example, the display can display an image only at an odd number of grayscale values in the grayscales of 0 to 255.

Figure 1:
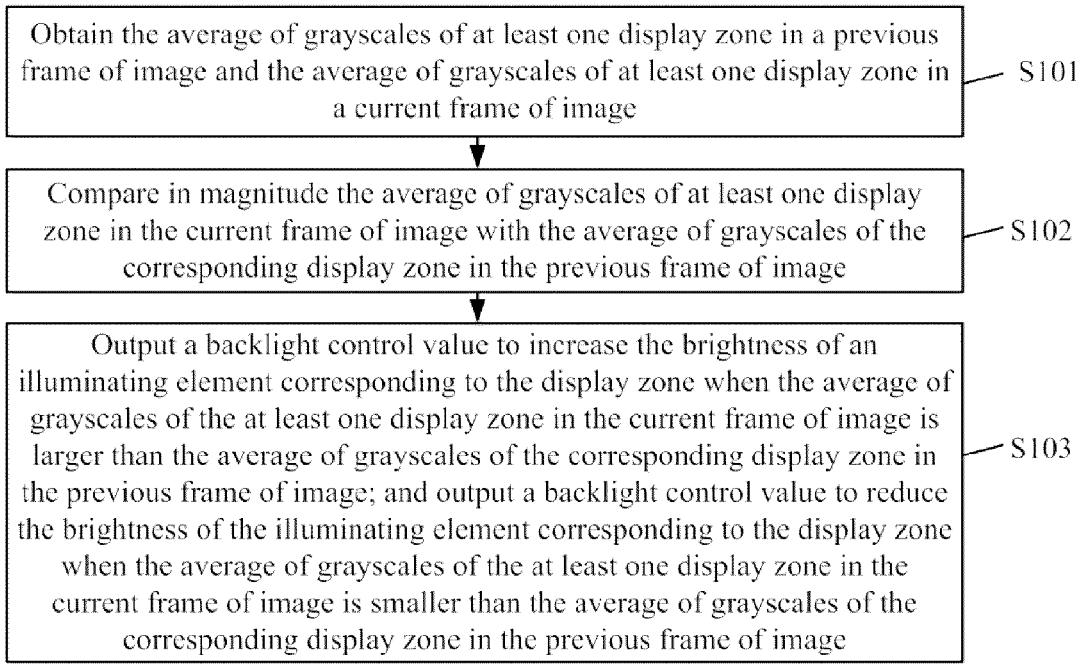
FIG. 1 is a schematic diagram of a method of processing a display signal according to some embodiments.

Some embodiments provides a method of processing a 3D display signal, applicable to a 3D display device including a plurality of illuminating elements, and as illustrated in FIG. 1, the method of processing includes:

The step S101 is to obtain the average of grayscales of at least one display zone in a previous frame of image and the average of grayscales of at least one display zone in a current frame of image.

Where a frame of image is divided into a plurality of display zones corresponding one-to-one to the illuminating elements, and each one of the display zones includes at least one pixel, and where the previous frame of image and the current frame of image are a left-eye image and a right-eye image respectively.

It shall be noted that the current frame of image which is a currently obtained image to be displayed is processed and then displayed.

The display device includes a plurality of illuminating elements which can be arranged on the bottom of a display panel, i.e., bottom-illuminating, or which can be arranged on the side of the display panel, i.e., side-illuminating, where the illuminating elements can be Light-Emitting Diodes (LEDs). Preferably some embodiments will be described below in details taking the illuminating elements on the bottom of the display panel as an example.

The frame of image is divided into a plurality of display zones corresponding one-to-one to illuminating elements, that is, the display panel can be divided into a plurality of display zones. The display zones correspond one-to-one to the illuminating elements, that is, a corresponding display zone is illuminated by an illuminating element, and the plurality of illuminating elements correspond to the entire display area of the display panel. The display zones each include at least one pixel, that is, the display zone can include only one pixel or can include a plurality of pixels. For example, the resolution of the display panel is 800*600, that is, the display panel includes 800*600 pixels, and when an illuminating element of the display zone corresponds to a pixel, then the display device includes 800*600 illuminating elements; and when the display zone includes less than 800*600 pixels, then an illuminating element corresponds to a plurality of pixels of the display zone. For example, the display panel includes 800*600 pixels, and the display device includes 10,000 LEDs, where the 800*600 pixels are divided into 10,000 display zones, that is, each display zone includes 48 pixels corresponding to an illuminating element, i.e., an LED. In some embodiments, a detailed description has been given taking an illuminating element corresponds to a plurality of pixels of the display zone as an example.

It shall be noted that the average of grayscales of the at least one display zone in the previous frame of image can be obtained by storing the calculated average of grayscales of the display zone in the course of processing the previous frame of image and retrieving the stored average of grayscales of the display zone in the previous frame of image from a memory in processing the current frame of image; or can be obtained by storing data in the previous frame of image and by extracting the data in the previous frame of image from the memory and calculating the average of grayscales of the display zone in the previous frame of image in processing the current frame of image. To obtain the average of grayscales of the at least one display zone in the current frame of image, after data in the current frame of image is received, one branch of the data in the current frame of image is converted into a display grayscale voltage to drive liquid crystal molecules in the display panel to control display grayscale brightness on the display panel, and another branch of the data in the current frame of image is temporarily stored per display zone, display grayscales of respective pixels in the at least one display zone are counted, and the average of grayscales of the image data in the display zone is calculated, or the average of grayscales in the display zone is stored so that the temporarily stored data in the current frame of image or the stored average of grayscales of the display zone in the current frame of image is called from the memory in processing a next frame of image for display.

Where for the average of grayscales of the at least one display zone in the previous frame of image and the average of grayscales of the at least one display zone in the current frame of image, the average of grayscales of the at least one display zone in the previous frame of image, and the average of grayscales of the at least one display zone in the current frame of image can be obtained at the same time; or firstly the average of grayscales of the at least one display zone in the previous frame of image and then the average of grayscales of the at least one display zone in the current frame of image can be obtained; or firstly the average of grayscales of the at least one display zone in the current frame of image and then the average of grayscales of the at least one display zone in the previous frame of image can be obtained. Some embodiments will not be limited to any particular order in which they can be obtained.

Figure 2:
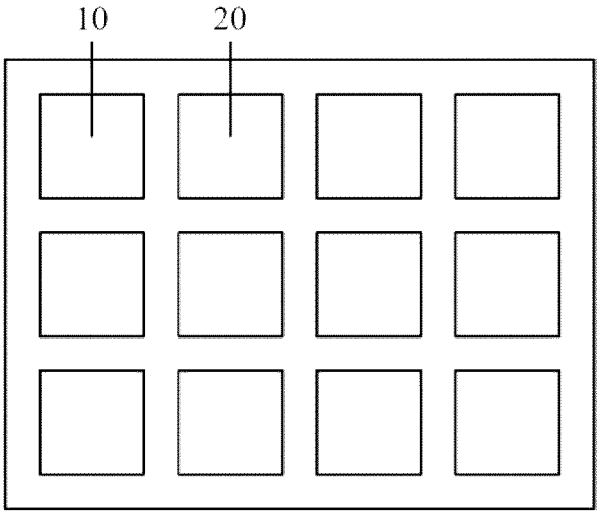
FIG. 2 is a schematic diagram of respective display zones of a display panel according to some embodiments.

The step S102 is to compare in magnitude the average of grayscales of the at least one display zone in the current frame of image with the average of grayscales of the corresponding display zone in the previous frame of image.

Where the obtained average of grayscales of the at least one display zone in the current frame of image is compared with the average of grayscales of the corresponding least one display zone in the previous frame of image. As illustrated in FIG. 2, a display image is divided into 12 display zones, grayscale values of respective pixels included in a display zone 10 in a current frame, and the average of grayscales of the respective pixels of the display zone 10 is counted, and correspondingly the average of grayscales of respective pixels of the display zone 10 in a previous frame of image is counted, and then the average of grayscales in the display zone 10 in the current frame is compared in magnitude with the average of grayscales of the corresponding display zone in the previous frame of image. Of course the magnitudes of the averages of grayscales of the other display zones need to be further handled sequentially in a real processing flow.

The step S103 is to output a backlight control value to increase the brightness of an illuminating element corresponding to the display zone when the average of grayscales of the at least one display zone in the current frame of image is larger than the average of grayscales of the corresponding display zone in the previous frame of image and to output a backlight control value to reduce the brightness of the illuminating element corresponding to the display zone when the average of grayscales of the at least one display zone in the current frame of image is smaller than the average of grayscales of the corresponding display zone in the previous frame of image.

It shall be noted that the backlight control value for the brightness of the illuminating element refers to the value of a parameter which can control or adjust the brightness of the illuminating element, e.g., the value of a duty ratio of the driving signal of the illuminating element or the value of a current of the driving signal of the illuminating element.

As illustrated in FIG. 2, if the average of grayscales of the display zone 10 in the current frame (for example, which can be a grayscale of 200) is larger than the average of grayscales of the corresponding display zone in the previous frame of image (for example, which can be a grayscale of 50), then a backlight control value to increase the brightness of an illuminating element corresponding to the display zone 10 is output. If the average of grayscales of the display zone 20 in the current frame (for example, which can be a grayscale of 50) is smaller than the average of grayscales of the corresponding display zone in the previous frame of image (for example, which can be a grayscale of 200), then a backlight control value to reduce the brightness of an illuminating element corresponding to the display zone 20 is output.

Only the display zone 10 and the display zone 20 have been taken above as an example, and a repeated description will be omitted here of a frame of image divided into a plurality of display zones so that a backlight control value to increase or reduce the brightness of a corresponding illuminating element is output according to the average of grayscales of each of the display zones in the current frame and the average of grayscales of the corresponding display zone in the previous frame of image.

Where the backlight control value to increase the brightness of the illuminating element corresponding to the display zone is output particularly by outputting the value of a duty ratio or the value of a current to increase the driving signal of the illuminating element corresponding to the display zone; and The backlight control value to reduce the brightness of the illuminating element corresponding to the display zone is output particularly by outputting the value of the duty ratio or the value of the current to reduce the driving signal of the illuminating element corresponding to the display zone.

"Increase" or "reduce" as referred above to is directed to the brightness value of the illuminating element when the current frame of image is displayed given the same grayscale value in the previous frame of image as that in the current frame of image, where given the same grayscale value in the previous frame of image as that in the current frame of image, the brightness of the illuminating element is controlled when the current frame of image is displayed is controlled normally without raising or reducing the duty ratio or the current.

It shall be noted that the duty ratio of the illuminating element refers to an illumination period of the illuminating element, for example, if the illumination period of the illuminating element is 1 s, that is, the duty ratio is 100%, by way of an example, then the duty ratio of the illuminating element is adjusted to 50%, that is, the illumination period of the illuminating element is 0.5 s.

With preset the brightness of a reference current, the larger the current of the illuminating element is, the higher the brightness of the illuminating element will be; and the smaller the current of the illuminating element is, the lower the brightness of the illuminating element will be, so the brightness of the illuminating element can be adjusted by adjusting the current of the illuminating element. For example, such a reference current-brightness relationship is preset that the brightness of the illuminating element is 350 nits at the current of 300 mA. Then the brightness of the illuminating element is 500 nits when the current is adjusted to 400 mA; and the brightness of the illuminating element is 300 nits when the current is adjusted to 250 mA.

In some embodiments, the current of the illuminating element corresponding to the display zone is adjusted by adjusting the duty ratio of the illuminating element of the display zone or by adjusting the current of the illuminating element of the display zone.

Optionally the value of the duty ratio or the value of the current to increase the driving signal of the illuminating element corresponding to the display zone is output; and the value of the duty ratio or the value of the current to reduce the driving signal of the illuminating element corresponding to the display zone is output, particularly as follows:

A search table is searched, with the average of grayscales of the corresponding display zone in the previous frame of image and the average of grayscales of the display zone in the current frame of image, for the value of the duty ratio or the value of the current of the illuminating element corresponding to the display zone in the current frame of image; and The value of the duty ratio or the value of the current is output.

Illustratively, as illustrated in FIG. 8, a first search table is searched, with the average of grayscales of some display zone in the current frame of image and the average of grayscales of the corresponding display zone in the previous frame of image, for the value of the duty ratio corresponding to the display zone to be output, i.e., the value of the duty ratio to increase or reduce the driving signal of the illuminating element corresponding to the display zone to be output. For example, taking a duty ratio 20% of the illuminating element of the display device as an example, where the duty ratio of the illuminating element is normally 20%, with the average 8 of grayscales of the display zone in the current frame of image and the average 16 of grayscales of the corresponding display zone in the previous frame of image, the first search table is searched for the value 18% of the duty ratio corresponding to the display zone to be output. That is, when the average of grayscales of the at least one display zone in the current frame of image of image is smaller than the average of grayscales of the corresponding display zone in the previous frame of image, then the value of the duty ratio to reduce the driving signal of the illuminating element corresponding to the display zone is output to reduce the brightness of the illuminating element corresponding to the display zone.

It shall be noted that in the first search table illustrated in FIG. 8, a duty ratio 20% of the illuminating element of the display device is taken as an example, where the duty ratio of the illuminating element is normally 20%. If the average of grayscales of the display zone in the current frame of image is equal to the average of grayscales of the corresponding display zone in the previous frame of image, then the brightness of the illuminating element of the display zone in the current frame of image will not be adjusted, and at this time, the duty ratio of the illuminating element is 20%.

Illustratively, as illustrated in FIG. 9, a second search table is searched, with the average of grayscales of some display zone in the current frame of image and the average of grayscales of the corresponding display zone in the previous frame of image, for the value of the current corresponding to the display zone to be output, i.e., the value of the current to increase or reduce the brightness of the illuminating element corresponding to the display zone to be output. For example, with the average 8 of grayscales of the display zone in the current frame of image and the average 16 of grayscales of the corresponding display zone in the previous frame of image, the second search table is searched for the value 295 mA of the current corresponding to the display zone to be output. That is, when the average of grayscales of the at least one display zone in the current frame of image is smaller than the average of grayscales of the corresponding display zone in the previous frame of image, then the value of the current to reduce the driving signal of the illuminating element corresponding to the display zone is output to reduce the brightness of the illuminating element corresponding to the display zone.

It shall be noted that in the second search table illustrated in FIG. 9, the current 300 mA of the illuminating element of the display device is taken as an example, where the current of the illuminating element is normally 300 mA. If the average of grayscales of the display zone in the current frame of image is equal to the average of grayscales of the corresponding display zone in the previous frame of image, then the brightness of the illuminating element of the display zone in the current frame of image will not be adjusted, and at this time, the current of the illuminating element is 300 mA.

It shall be noted that FIG. 8 and FIG. 9 illustrate 8-bit mapping, and of course 10-bit or 12-bit mapping or the like is also possible, and in some embodiments, a detailed description has been given only taking 8-bit mapping as an example.

It shall be noted that the method of processing according to some embodiments can be performed based upon dynamic backlight adjustment, where an implementation of dynamic backlight adjustment can include counting the average of grayscales of some display zone in the current frame to obtain a backlight gain value corresponding to the display zone and obtaining a first backlight control value from the average of grayscales of the display zone and the backlight gain value corresponding to the display zone (i.e., a backlight control value as a result of dynamic backlight adjustment).

With the method of processing according to some embodiments combined based upon dynamic backlight adjustment, if the average of grayscales of the display zone in the current frame is larger than the average of grayscales of the corresponding display zone in the previous frame, then the first backlight control value of the display zone is increased to a second backlight control value, and the illuminating element corresponding to the display zone is driven by the second backlight control value; and if the average of grayscales of the display zone in the current frame is smaller than the average of grayscales of the corresponding display zone in the previous frame, then the first backlight control value of the display zone is reduced to a third backlight control value, and the illuminating element corresponding to the display zone is driven by the third backlight control value.

Figures 15, 16:
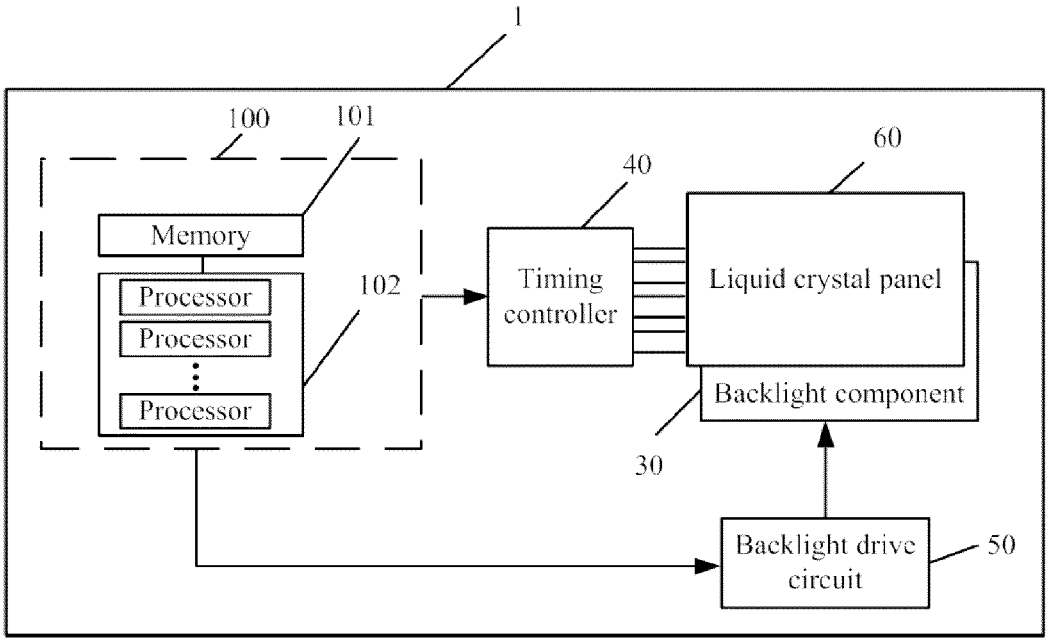
FIG. 15 is a schematic diagram of another display device according to some embodiments.
FIG. 16 is a schematic diagram of a third search table according to some embodiments.

Illustratively, as illustrated in FIG. 16, a duty ratio curve of the first backlight control value is obtained from the average of display grayscales in the current frame, where a grayscale of 0 corresponds to a duty ratio of 10%, a grayscale of 8 corresponds to a duty ratio of 11%, a grayscale of 16 corresponds to a duty ratio of 12%, a grayscale of N corresponds to a duty ratio of 15%, and a grayscale of 255 corresponds to a duty ratio of 14%. With the average 16 of grayscales of some display zone in the previous frame and the average of grayscales 8 thereof in the current frame, the third search table is searched for the duty ratio of 10%, so the duty ratio of backlight control is reduced as compared with the duty ratio 11% of the normally unadjusted first backlight control value at the grayscale of 8. In another example, with the average 0 of grayscales of some display zone in the previous frame of image and the average of grayscales 8 of the display zone in the current frame of image, the third search table is searched for the duty ratio of 12%, so the duty ratio is increased as compared with the duty ratio 11% of unadjusted backlight at the grayscale of 8 to thereby increase the brightness of the illuminating element.

Some embodiments provides a method of processing a display signal, with the method of processing a display signal, the average of grayscales of at least one display zone in a previous frame of image and the average of grayscales of at least one display zone in a current frame of image are obtained, and a backlight control value to increase the brightness of the illuminating element corresponding to the display zone is output to increase the brightness of the illuminating element corresponding to the display zone when the average of grayscales of the at least one display zone in the current frame of image is larger than the average of grayscales of the corresponding display zone in the previous frame of image; and a backlight control value to reduce the brightness of the illuminating element corresponding to the display zone is output to reduce the brightness of the illuminating element corresponding to the display zone when the average of grayscales of the at least one display zone in the current frame of image is smaller than the average of grayscales of the corresponding display zone in the previous frame of image, that is, a display grayscale of a pixel is adjusted by adjusting the brightness of an illuminating element corresponding to a display zone where the pixel is located to thereby speed up grayscale display of pictures received by the left eye and the right eye and reduce a crosstalk between the images of the left eye and the right eye so as to improve a visual effect.

Figure 3:
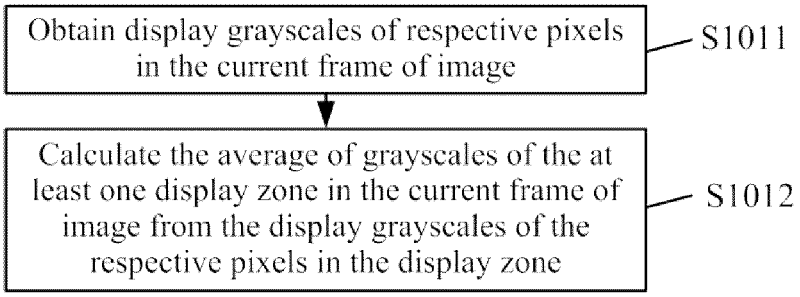
FIG. 3 is a schematic diagram of a method of obtaining the average of grayscales of at least one display zone in a current frame according to some embodiments.

Optionally as illustrated in FIG. 3, the average of grayscales of the at least one display zone in the current frame of image is obtained in the step S101 particularly as follows:

The step S1011 is to obtain display grayscales of respective pixels in the current frame of image.

Particularly, the resolution of the display panel is 800*600, that is, the display panel includes 800*600 pixels, and the display grayscales of the respective pixels in the current frame of image are obtained by obtaining display grayscales of the 800*600 pixels in the current frame of image.

The step S1012 is to calculate the average of grayscales of the at least one display zone in the current frame of image from the display grayscales of the respective pixels in the display zone.

For example, a display zone includes 48 pixels, and the average of grayscales of the 48 pixels in the display zone is calculated from display grayscales of the 48 pixels.

Figure 4:
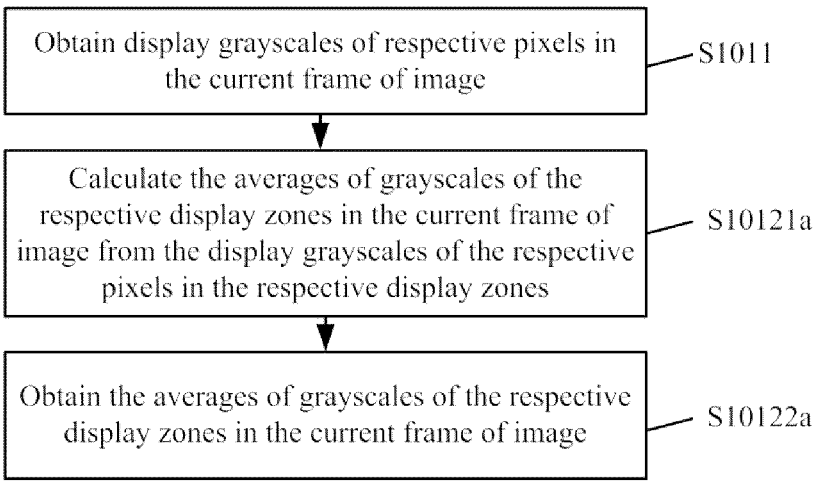
FIG. 4 is a schematic diagram of a method of calculating the average of grayscales of respective display zones according to some embodiments.

Optionally as illustrated in FIG. 4, the step S1012 particularly includes:

The step S10121*a* is to calculate the averages of grayscales of the respective display zones in the current frame of image from the display grayscales of the respective pixels in the respective display zones.

For example, the display panel includes 800*600 pixels divided into 10,000 display zones, that is, each display zone includes 48 pixels. The averages of grayscales of the respective display zones in the current frame of image are calculated from the display grayscales of the respective pixels in the respective display zones by calculating averages of grayscales of the 10,000 display zones.

The step S10122*a* is to obtain the averages of grayscales of the respective display zones in the current frame of image.

That is, the averages of grayscales of the 10,000 display zones in the step S10121*a* are obtained.

Where in the step S101 above, the average of grayscales of the at least one display zone in the previous frame of image is obtained particularly as follows:

The averages of grayscales of the respective display zones in the previous frame of image are obtained.

Particularly the averages of grayscales of the respective display zones in the previous frame of image can be obtained by obtaining the pre-stored averages of grayscales of the respective display zones in the previous frame of image.

Particularly in the step S102 above, the averages of grayscales of the respective display zones in the current frame are compared with the averages of grayscales of the respective display zones in the previous frame.

That is, the averages of grayscales of the respective display zones in the current frame of image are obtained as in the method illustrated in FIG. 4, and the pre-stored averages of grayscales of the respective display zones in the previous frame of image are obtained, and the averages of grayscales of the respective display zones in the current frame of image are compared with the averages of grayscales of the respective display zones in the previous frame of image, and the backlight control values to increase or reduce the brightness of the illuminating elements corresponding to the respective display zones in the current frame of image are determined and output.

Figure 5:
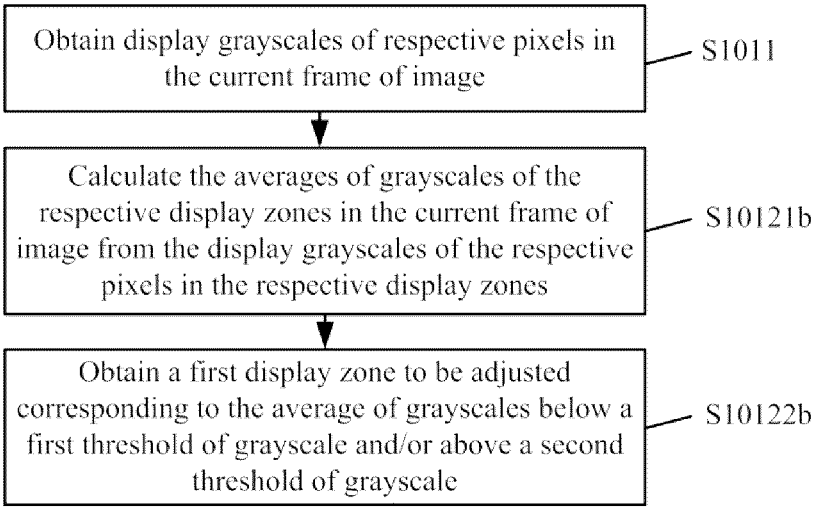
FIG. 5 is a schematic diagram of a method of obtaining a first display zone to be adjusted according to some embodiments.

Optionally as illustrated in FIG. 5, the step S1012 above particularly includes:

The step S10121*b* is to calculate the averages of grayscales of the respective display zones in the current frame of image from the display grayscales of the respective pixels in the respective display zones.

For details thereof, reference can be made to the step S10121*a* above, and a repeated description thereof will be omitted here.

The step S10122*b* is to obtain a first display zone to be adjusted corresponding to the average of grayscales below a first threshold of grayscale and/or above a second threshold of grayscale.

Where the second threshold is larger than the first threshold, for example, the first threshold is a grayscale of 32, and the second threshold is a grayscale of 200, and where the values of the first threshold and the second threshold are preset according to a characteristic parameter and a design need of the liquid crystal panel, and some embodiments will not be limited to any particular values thereof, and a detailed description has been given only taking the values above as an example.

The first display zone to be adjusted corresponding to the average of grayscales below the first threshold of grayscale and/or above the second threshold of grayscale can be obtained, for example, by obtaining only the first display zone to be adjusted corresponding to the average of grayscales smaller than a grayscale of 32; or can be obtained by obtaining only the first display zone to be adjusted corresponding to the average of grayscales larger than a grayscale of 200; or can be obtained by obtaining the first display zones to be adjusted corresponding to the average of grayscales smaller than a grayscale of 32 and larger than a grayscale of 200.

Of course, alternatively the first display zone to be adjusted corresponding to the average of grayscales smaller than a grayscale of 20 and/or larger than a grayscale of 220 can be obtained. Since Over Drive (OD) may result in an insignificant influence upon a pixel at a too low grayscale or a too high grayscale, preferably the pixels at a low grayscale and a high grayscale are adjusted in some embodiments, but a particular grayscale value(s) can be preset particularly for the display, and in some embodiments, a detailed description has been given only taking as the first display zone to be adjusted corresponding to the average of grayscales below a grayscale of 32 and/or a grayscale of 200.

Particularly in the step S101 above, the average of grayscales of the at least one display zone in the previous frame of image is obtained particularly as follows:

The average of grayscales of the first display zone to be adjusted in the previous frame of image is obtained.

Of course, alternatively the averages of grayscales of the respective display zones in the previous frame of image can be obtained, but when the first display zone to be adjusted in the current frame is obtained, the average of grayscales of the at least one display zone in the current frame can be compared in magnitude with the average of grayscales of the corresponding display zone in the previous frame of image by comparing only the average of grayscales corresponding to the first display zone to be adjusted in the current frame with the average of grayscales corresponding to the first display zone to be adjusted in the previous frame, and the backlight control value to increase or reduce the brightness of the illuminating element corresponding to the first display zone to be adjusted in the current frame is output.

Where in the step S102 above, the average of grayscales of the at least one display zone in the current frame is compared in magnitude with the average of grayscales of the corresponding display zone in the previous frame of image particularly as follows:

The average of grayscales of the first display zone to be adjusted in the current frame is compared with the average of grayscales of the corresponding display zone in the previous frame.

That is, the average of grayscales of the first display zone to be adjusted in the current frame of image is obtained as in the method illustrated in FIG. 5, and the pre-stored average of grayscales of the first display zone to be adjusted in the previous frame of image can be obtained, and the average of grayscales of the first display zone to be adjusted in the current frame is compared with the average of grayscales of the corresponding display zone in the previous frame, and the backlight control value to increase or reduce the brightness of the illuminating element corresponding to the first display zone to be adjusted in the current frame of image is determined and output.

Figure 6:
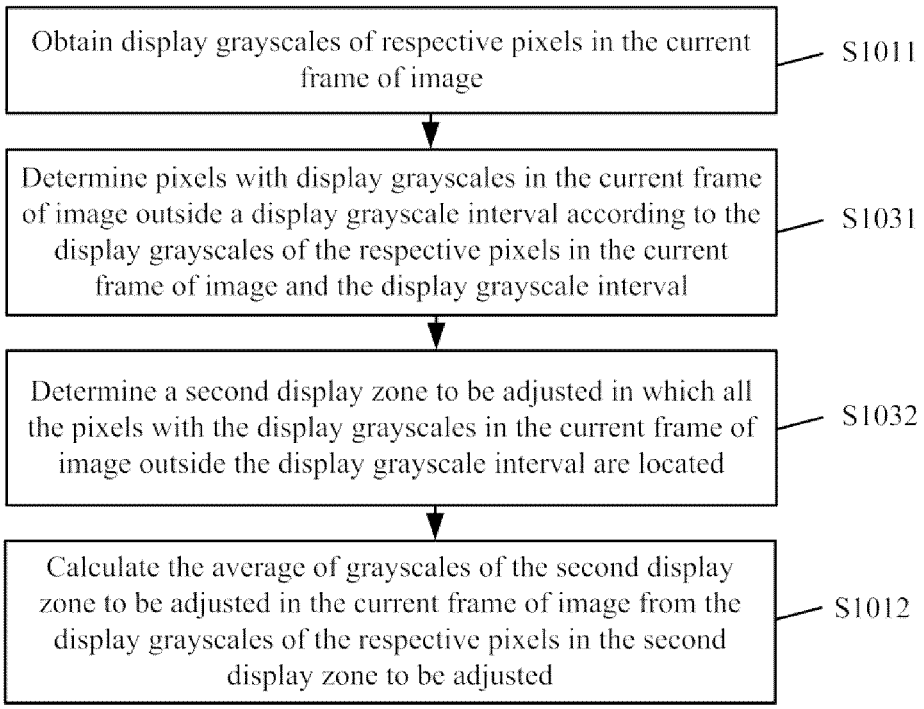
FIG. 6 is a schematic diagram of a method of calculating the average of grayscales of a second display zone to be adjusted according to some embodiments.

Optionally as illustrated in FIG. 6, before the step S1012 above, the method of processing further includes:

The step S1031 is to determine pixels with display grayscales in the current frame of image outside a display grayscale interval according to the display grayscales of the respective pixels in the current frame of image and the display grayscale interval.

Particularly the display grayscale interval can be grayscales of 32 to 200, and pixels with display grayscales other than the grayscales of 32 to 200 among the 800*600 pixels in the current frame of image are determined according to the display grayscales of the 800*600 pixels in the current frame of image.

Of course the display grayscale interval can alternatively be grayscales 20 to 220 or the like and can be adjusted differently for the particular display device, and in some embodiments, a detailed description has been given only taking the display grayscale interval being grayscales of 32 to 200 as an example.

The step S1032 is to determine a second display zone to be adjusted in which all the pixels with the display grayscales in the current frame of image outside the display grayscale interval are located.

That is, all the display grayscales of the respective pixels in the second display zone to be adjusted are in the display grayscale interval. Optionally the display grayscales in the display grayscale interval are grayscales of 32 to 200.

Particularly in the step S1012, the average of grayscales of the second display zone to be adjusted in the current frame of image is calculated from the display grayscales of the respective pixels in the second display zone to be adjusted.

Where in the step S101, the average of grayscales of the at least one display zone in the previous frame of image is obtained particularly as follows:

The average of grayscales of the second display zone to be adjusted in the previous frame of image is obtained.

Of course, alternatively the averages of grayscales of the respective display zones in the previous frame of image can be obtained, but when the second display zone to be adjusted in the current frame is obtained, the average of grayscales of the at least one display zone in the current frame can be compared in magnitude with the average of grayscales of the corresponding display zone in the previous frame of image by comparing only the average of grayscales corresponding to the second display zone to be adjusted in the current frame with the average of grayscales corresponding to the second display zone to be adjusted in the previous frame, and the backlight control value to increase or reduce the brightness of the illuminating element corresponding to the second display zone to be adjusted in the current frame is output.

Particularly in the step S102, the average of grayscales of the second display zone to be adjusted in the current frame is compared with the average of grayscales of the corresponding display zone in the previous frame.

That is, the average of grayscales of the second display zone to be adjusted in the current frame of image is obtained as in the method illustrated in FIG. 6, and the pre-stored average of grayscales of the second display zone to be adjusted in the previous frame of image can be obtained, and the average of grayscales of the second display zone to be adjusted in the current frame is compared with the average of grayscales of the corresponding display zone in the previous frame, and the backlight control value to increase or reduce the brightness of the illuminating element corresponding to the second display zone to be adjusted in the current frame of image is determined and output.

Figure 7:
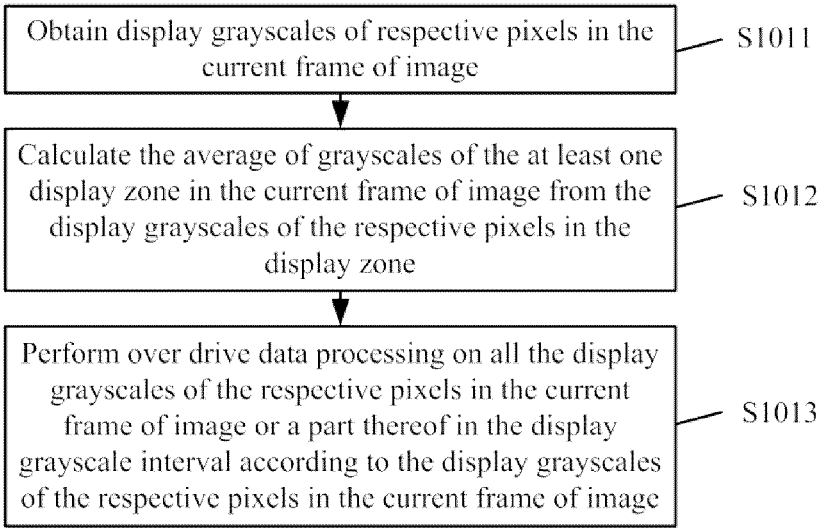
FIG. 7 is a schematic diagram of another method of processing a display signal according to some embodiments.

Optionally as illustrated in FIG. 7, after the step S1012, the method of processing further includes:

Step 1013 is to perform over drive data processing on all the display grayscales of the respective pixels in the current frame of image or a part thereof in the display grayscale interval according to the display grayscales of the respective pixels in the current frame of image.

Over drive data processing can be performed on all or a part of the respective pixels in the current frame of image by performing over drive on all the respective pixels in the current frame of image or by performing over drive on a part of the respective pixels in the current frame of image, where the part of the respective pixels can be preset pixels.

Particularly, over drive data processing can be performed on all or a part of the pixels in the current frame of image can be performed as in an existing output processing method of over drive, and a repeated description thereof will be omitted here.

Optionally the display grayscales of the display grayscale interval are grayscales of 32 to 200. Over drive data processing is performed on the respective pixels in the display grayscale interval, where the respective pixels in the display grayscale interval can be respective pixels in a grayscale interval of 32 to 200 or can be respective pixels in a grayscale interval of 20 to 220 or can be respective pixels in a grayscale interval of 8 to 248. In some embodiments, a detailed description has been given taking as an example the respective pixels in the display grayscale interval being respective pixels with grayscales in a grayscale interval of 32 to 200.

Some embodiments provides a method of processing a display signal, and in a flow of processing a 3D display signal, on one hand, over drive data processing is performed on respective pixels to thereby increase a voltage so as to shorten a response time of liquid crystals and alleviate a crosstalk ghost in 3D; and on the other hand, a display grayscale of a pixel is adjusted by adjusting the brightness of an illuminating element corresponding to the pixel to thereby speed up display switching between left-eye and right-eye pictures and further alleviate a crosstalk ghost in 3D, and due to an insignificant OD effect particularly on relatively white and relatively black pixel elements, grayscale display of pictures received by the left eye and the right eye can be further speeded up by adjusting the brightness of illuminating elements to thereby alleviate a crosstalk between left-eye and right-eye images and thus improve a visual effect.

Figure 10:
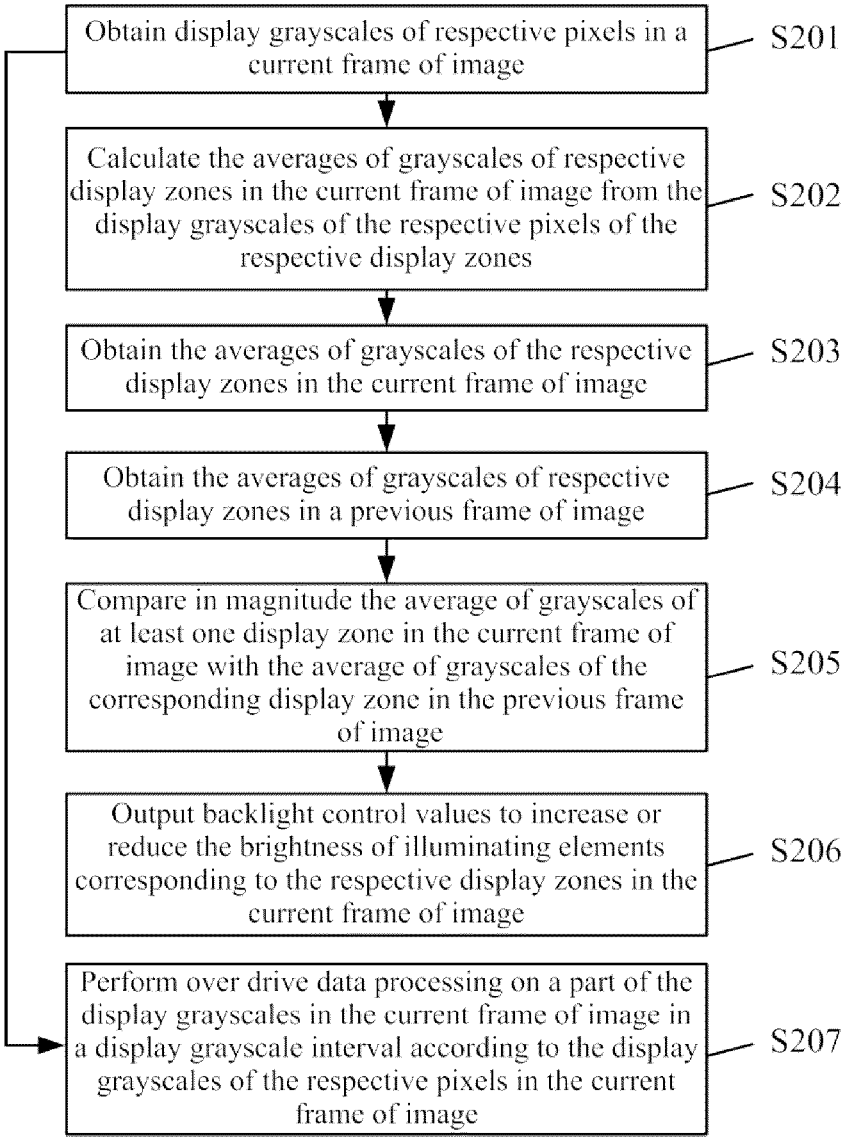
FIG. 10 is a schematic diagram of a particular method of processing a display signal according to some embodiments.

The method of processing a display signal according to some embodiments will be described below in a particular embodiment thereof, and as illustrated in FIG. 10, the method includes:

The step S201 is to obtain display grayscales of respective pixels in a current frame of image.

For details of the step S201, reference can be made to the step S1011 above, and a repeated description thereof will be omitted here.

The step S202 is to calculate the averages of grayscales of respective display zones in the current frame of image from the display grayscales of the respective pixels of the respective display zones.

For details of the step S202, reference can be made to the step S10121*a* above, and a repeated description thereof will be omitted here.

The step S203 is to obtain the averages of grayscales of the respective display zones in the current frame of image.

For details of the step S203, reference can be made to the step S10122*a* above, and a repeated description thereof will be omitted here.

The step S204 is to obtain the averages of grayscales of respective display zones in a previous frame of image.

Particularly the pre-stored averages of grayscales of the respective display zones in the previous frame of image can be obtained.

The step S205 is to compare in magnitude the average of grayscales of at least one display zone in the current frame of image with the average of grayscales of the corresponding display zone in the previous frame of image.

For details of the step S205, reference can be made to the step S102 above.

The step S206 is to output backlight control values to increase or reduce the brightness of illuminating elements corresponding to the respective display zones in the current frame of image.

For details of outputting the backlight control values to increase the brightness of the illuminating elements corresponding to the respective display zones in the current frame of image or outputting the backlight control values to reduce the brightness of the illuminating elements corresponding to the respective display zones in the current frame of image, reference can be made to the step S103 above.

The step S207 is to perform over drive data processing on a part of the display grayscales in the current frame of image in a display grayscale interval according to the display grayscales of the respective pixels in the current frame of image.

Particularly the respective pixels in the display grayscale interval can be respective pixels with grayscales in a grayscale interval of 32 to 200 or can be respective pixels with grayscales in a grayscale interval of 20 to 220 or can be respective pixels with grayscales in a grayscale interval of 8 to 248. In some embodiments, a detailed description has been given taking as an example the respective pixels in the display grayscale interval being respective pixels with grayscales in a grayscale interval of 32 to 200.

For details of over drive performed on the part of the display grayscales in the current frame of image in the display grayscale interval, reference can be made to the existing scheme of over drive, and a repeated description thereof will be omitted here.

Some embodiments provides a method of processing a display signal, and in a 3D display process in the method of processing a display signal, on one hand, over drive is performed on respective pixels to thereby increase a voltage so as to shorten a response time of liquid crystals and alleviate a crosstalk ghost in 3D; and on the other hand, a display grayscale of a pixel is adjusted by adjusting the brightness of an illuminating element corresponding to the pixel to thereby speed up display switching between left-eye and right-eye pictures and further alleviate a crosstalk ghost in 3D, and due to an insignificant OD effect particularly on relatively white and relatively black pixel elements, grayscale display of pictures received by the left eye and the right eye can be further speeded up by adjusting the brightness of illuminating elements to thereby alleviate a crosstalk between left-eye and right-eye images and thus improve a visual effect.

Figure 11:
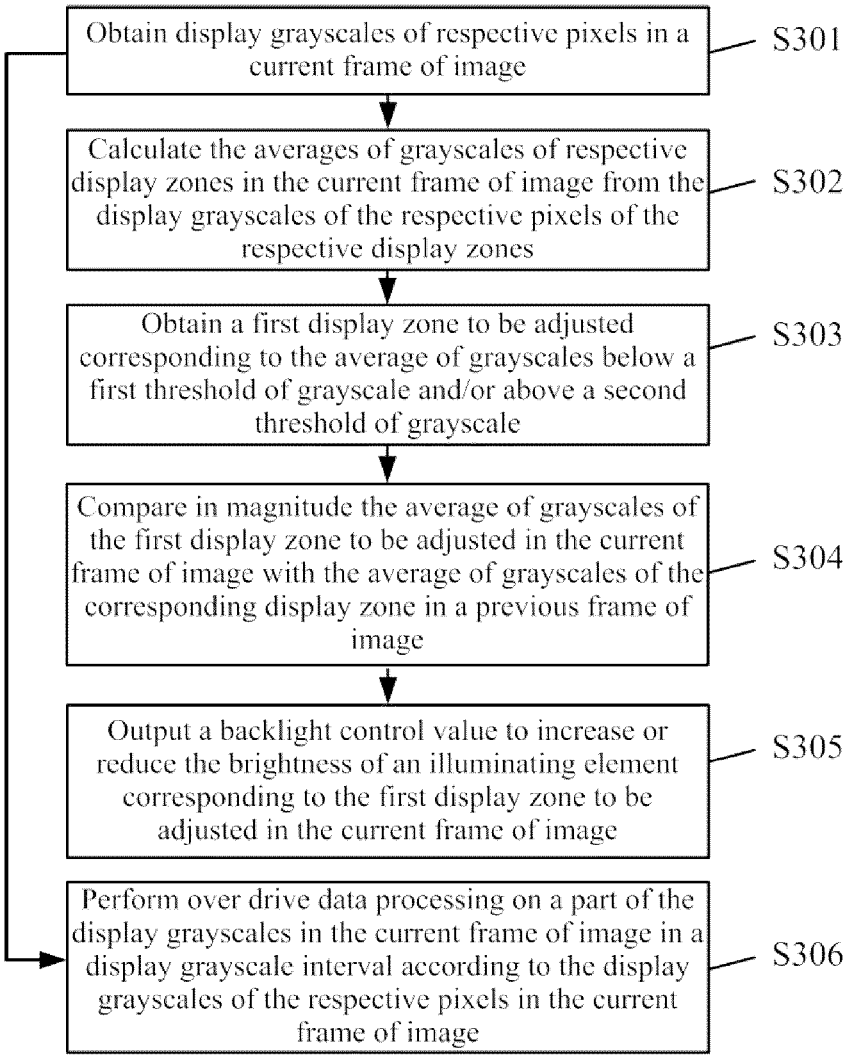
FIG. 11 is a schematic diagram of another particular method of processing a display signal according to some embodiments.

The method of processing a display signal according to some embodiments will be described below in a particular embodiment thereof, and as illustrated in FIG. 11, the method includes:

The step S301 is to obtain display grayscales of respective pixels in a current frame of image.

For details of the step S301, reference can be made to the step S1011 above, and a repeated description thereof will be omitted here.

The step S302 is to calculate the averages of grayscales of respective display zones in the current frame of image from the display grayscales of the respective pixels of the respective display zones.

For details of the step S302, reference can be made to the step S10121*b* above, and a repeated description thereof will be omitted here.

The step S303 is to obtain a first display zone to be adjusted corresponding to the average of grayscales below a first threshold of grayscale and/or above a second threshold of grayscale.

Where the second threshold is larger than the first threshold, for example, the first threshold is 32, and the second threshold is 200, and where the values of the first threshold and the second threshold are preset according to a characteristic parameter and a design need of a liquid crystal panel.

For details of the step S303, reference can be made to the step S10122*b* above, and a repeated description thereof will be omitted here.

The step S304 is to compare in magnitude the average of grayscales of the first display zone to be adjusted in the current frame of image with the average of grayscales of the corresponding display zone in a previous frame of image.

For details of the step S304, reference can be made to the step S102 above.

The step S305 is to output a backlight control value to increase or reduce the brightness of an illuminating element corresponding to the first display zone to be adjusted in the current frame of image.

For details of outputting the backlight control value to increase or reduce the brightness of the illuminating element corresponding to the first display zone to be adjusted in the current frame of image, reference can be made to the step S103 above.

The step S306 is to perform over drive data processing on a part of the display grayscales in the current frame of image in a display grayscale interval according to the display grayscales of the respective pixels in the current frame of image.

For details of the step S306, reference can be made to the step S206 above, and a repeated description thereof will be omitted here.

Some embodiments provides a method of processing a display signal, applicable to in a 3D display process, and on one hand, over drive is performed on respective pixels to thereby increase a voltage so as to shorten a response time of liquid crystals and alleviate a crosstalk ghost in 3D; and on the other hand, since there may be an insignificant drive effect of over drive on a relatively white pixel element (e.g., at a grayscale above 200) and a relatively black pixel element (e.g., at a grayscale below 32), preferably in some embodiments, the brightness of backlight is adjusted to thereby adjust the brightness of sections, at a relatively low average of grayscales and at a relatively high average of grayscales, of a display zone in a current frame of image so as to adjust display grayscales of the pixels to thereby speed up display switching between left-eye and right-eye pictures and further alleviate a crosstalk ghost in 3D, that is, due to an insignificant OD effect on the relatively white and relatively black pixel elements, grayscale display of pictures received by the left eye and the right eye can be further speeded up by adjusting the brightness of illuminating elements to thereby alleviate a crosstalk between left-eye and right-eye images and thus improve a visual effect.

Figure 12:
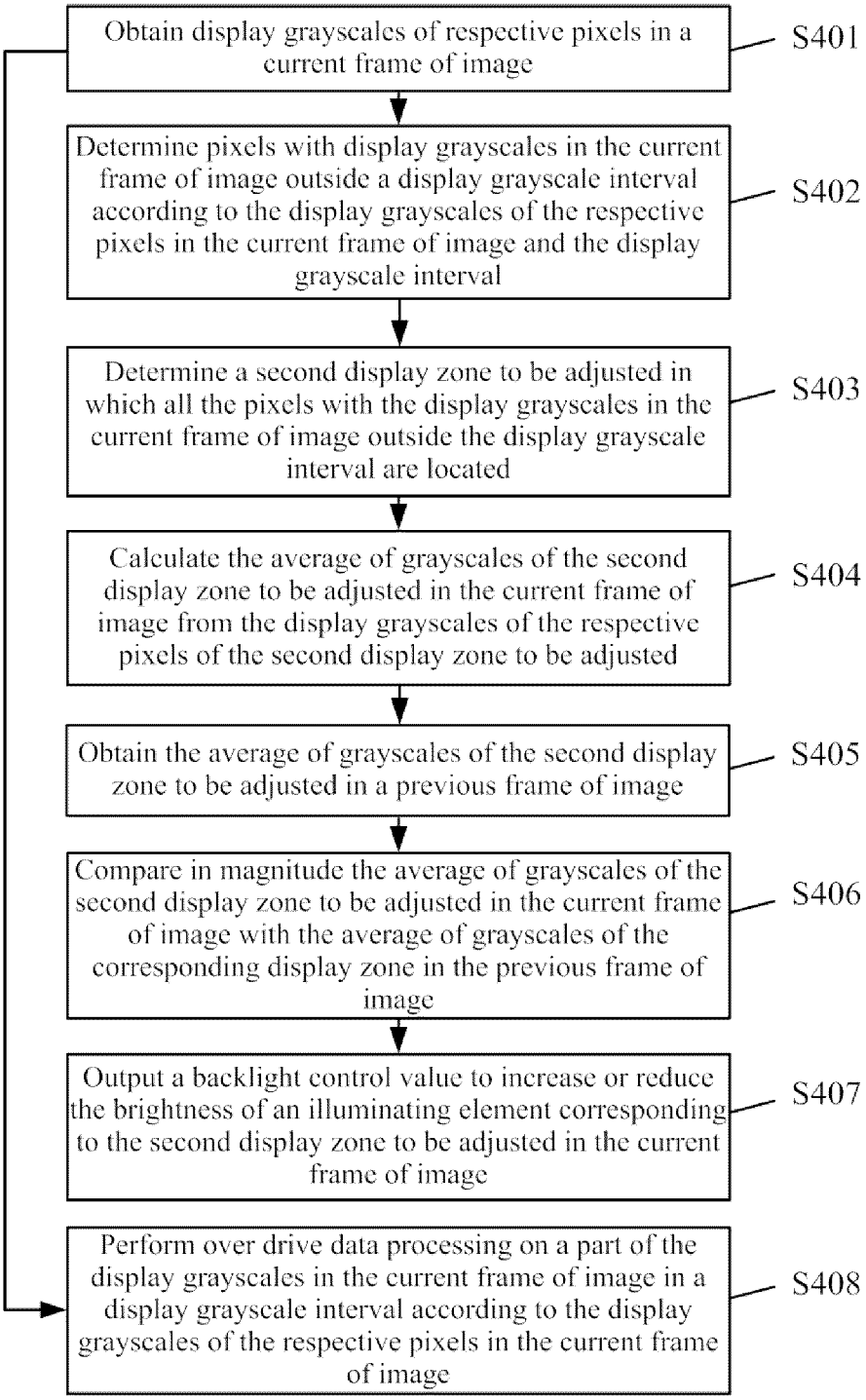
FIG. 12 is a schematic diagram of another particular method of processing a display signal according to some embodiments.

The method of processing a display signal according to some embodiments will be described below in a particular embodiment thereof, and as illustrated in FIG. 12, the method includes:

The step S401 is to obtain display grayscales of respective pixels in a current frame of image.

For details of the step S401, reference can be made to the step S1011 above, and a repeated description thereof will be omitted here.

The step S402 is to determine pixels with display grayscales in the current frame of image outside a display grayscale interval according to the display grayscales of the respective pixels in the current frame of image and the display grayscale interval.

For details of the step S402, reference can be made to the step S1031 above, and a repeated description thereof will be omitted here.

The step S403 is to determine a second display zone to be adjusted in which all the pixels with the display grayscales in the current frame of image outside the display grayscale interval are located.

For details of the step S403, reference can be made to the step S1032 above, and a repeated description thereof will be omitted here. It shall be noted that grayscale values of pixels in a display zone are typically close to each other, for example, when the display grayscale of a pixel in the display zone is a grayscale of 30, display grayscales of pixels around the pixel are approximately a grayscale of 30. When the grayscale values of the pixels in the display zone are relatively low, there may be an insignificant effect of over drive on the respective pixels in the display zone, and then the brightness of a corresponding illuminating element of the display zone to thereby adjust the display grayscale thereof The step S404 is to calculate the average of grayscales of the second display zone to be adjusted in the current frame of image from the display grayscales of the respective pixels of the second display zone to be adjusted.

The step S405 is to obtain the average of grayscales of the second display zone to be adjusted in a previous frame of image.

The step S406 is to compare in magnitude the average of grayscales of the second display zone to be adjusted in the current frame of image with the average of grayscales of the corresponding display zone in the previous frame of image.

For details of the step S406, reference can be made to the step S102 above.

The step S407 is to output a backlight control value to increase or reduce the brightness of an illuminating element corresponding to the second display zone to be adjusted in the current frame of image.

For details of outputting the backlight control value to increase or reduce the brightness of the illuminating element corresponding to the second display zone to be adjusted in the current frame of image, reference can be made to the step S103 above.

The step S408 is to perform over drive data processing on a part of the display grayscales in the current frame of image in a display grayscale interval according to the display grayscales of the respective pixels in the current frame of image.

For details of the step S408, reference can be made to the step S206 above, and a repeated description thereof will be omitted here.

Some embodiments provides a method of processing a display signal, and in a 3D display process, on one hand, over drive is performed on respective pixels to thereby increase a voltage so as to shorten a response time of liquid crystals and alleviate a crosstalk ghost in 3D; and on the other hand, since there may be an insignificant drive effect of over drive on a relatively white pixel element (e.g., at a grayscale above 200) and a relatively black pixel element (e.g., at a grayscale below 32), preferably in some embodiments, the brightness of backlight is adjusted to thereby adjust the brightness of sections, at a relatively low average of grayscales and at a relatively high average of grayscales, of a display zone in a current frame of image so as to adjust display grayscales of the pixels to thereby speed up display switching between left-eye and right-eye pictures and further alleviate a crosstalk ghost in 3D, that is, due to an insignificant OD effect on the relatively white and relatively black pixel elements, grayscale display of pictures received by the left eye and the right eye can be further speeded up by adjusting the brightness of illuminating elements to thereby alleviate a crosstalk between left-eye and right-eye images and thus improve a visual effect.

It shall be noted that the methods of processing as illustrated in FIG. 10 to FIG. 12 according to some embodiments have been described only taking over drive performed on the part of the display grayscales in the current frame of image in the display grayscale interval as an example, and of course, alternatively over drive can be performed on all the respective pixels in the current frame of image, and for details thereof, reference can be made to the steps above, and a repeated description thereof will be omitted here.

Hereinafter some embodiments provides an apparatus corresponding to the foregoing method of processing, and it shall be noted that for details of respective functions performed by processors included in the apparatus below, reference can be made to the corresponding steps in the method above, so a detailed description of the respective functions performed by processors of the apparatus will be omitted in the following embodiment.

Figure 13:
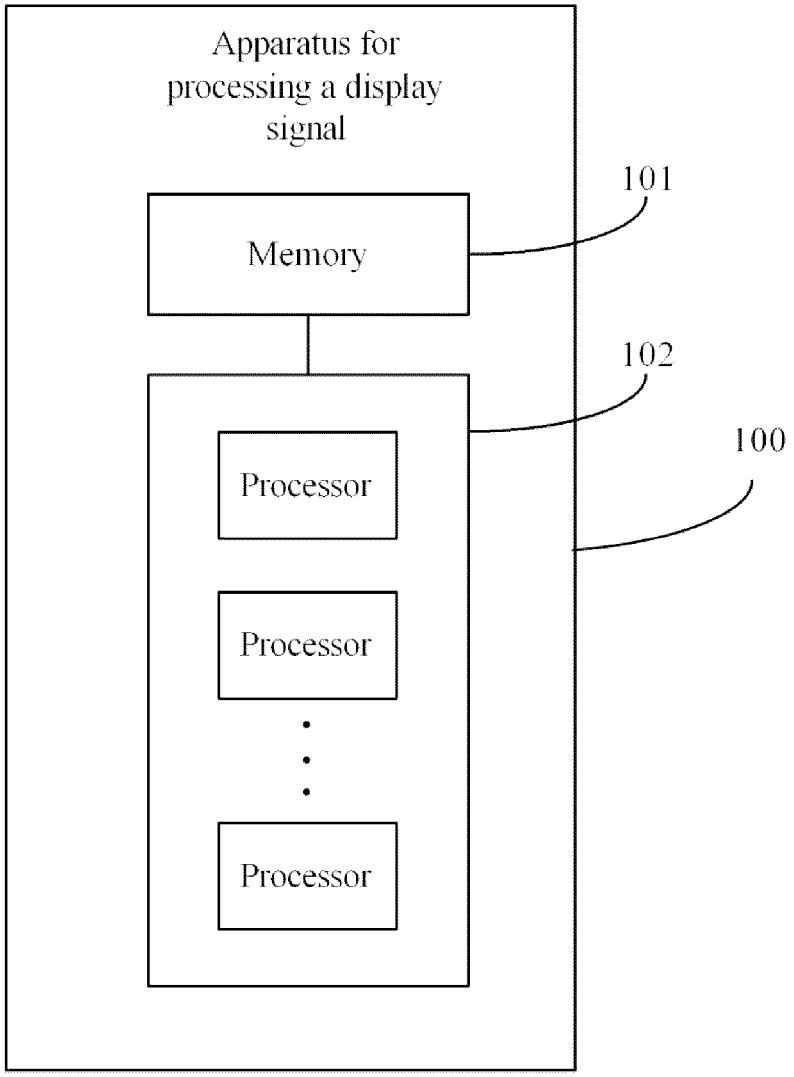
FIG. 13 is a schematic diagram of an apparatus for processing a display signal according to some embodiments.

Some embodiments provides an apparatus 100 for processing a display signal, the apparatus 100 for processing a display signal can be an integrated video processing chip or can be composed of a plurality of video processing chips, and as illustrated in FIG. 13, the apparatus 100 for processing a display signal particularly includes a memory 101; and one or more processors 102, wherein the memory 101 is configured to store computer readable program codes, and the one or more processors 102 execute the computer readable program codes to implement:

Obtaining the average of grayscales of at least one display zone in a previous frame of image;

Obtaining the average of grayscales of at least one display zone in a current frame of image, wherein a frame of image is divided into a plurality of display zones, and each one of the display zones includes at least one pixel; and wherein the previous frame of image and the current frame of image are a left-eye image and a right-eye image respectively;

Comparing in magnitude the average of grayscales of the at least one display zone in the current frame of image with the average of grayscales of the corresponding display zone in the previous frame of image; and Outputting a backlight control value to increase the brightness of an illuminating element corresponding to the display zone when the average of grayscales of the at least one display zone in the current frame of image is larger than the average of grayscales of the corresponding display zone in the previous frame of image and to output a backlight control value to reduce the brightness of the illuminating element corresponding to the display zone when the average of grayscales of the at least one display zone in the current frame of image is smaller than the average of grayscales of the corresponding display zone in the previous frame of image.

The average of grayscales of the at least one display zone in the previous frame of image can be obtained by obtaining directly the pre-stored averages of grayscales of the respective display zones in the previous frame of image.

Where a frame of image is divided into a plurality of display zones corresponding one-to-one to illuminating elements, and each one of the display zones includes at least one pixel, and where the previous frame of image and the current frame of image are a left-eye image and a right-eye image respectively.

It shall be noted that the average of grayscales of at least one display zone in a previous frame of image and the average of grayscales of at least one display zone in a current frame of image can be obtained concurrently or sequentially, and some embodiments will not be limited to any particular order in which obtain the average of grayscales of at least one display zone in a previous frame of image and the average of grayscales of at least one display zone in a current frame of image sequentially.

As illustrated in FIG. 2, if the average of grayscales of the display zone 10 in the current frame (for example, which can be a grayscale of 200) is larger than the average of grayscales of the corresponding display zone in the previous frame of image (for example, which can be a grayscale of 50), then outputs a backlight control value to increase the brightness of an illuminating element corresponding to the display zone 10. If the average of grayscales of the display zone 20 in the current frame (for example, which can be a grayscale of 50) is smaller than the average of grayscales of the corresponding display zone in the previous frame of image (for example, which can be a grayscale of 200), then outputs a backlight control value to reduce the brightness of an illuminating element corresponding to the display zone 20.

Only the display zone 10 and the display zone 20 have been taken above as an example, and a repeated description will be omitted here of a frame of image divided into a plurality of display zones so that a backlight control value to increase or reduce the brightness of a corresponding illuminating element is output according to the average of grayscales of each of the display zones in the current frame and the average of grayscales of the corresponding display zone in the previous frame of image.

Optionally, the obtaining the average of grayscales of the at least one display zone in the current frame of image includes:

Obtaining display grayscales of respective pixels in the current frame of image.

The resolution of a display panel is 800*600, that is, the display panel includes 800*600 pixels, and the display grayscales of the respective pixels in the current frame of image are obtained by obtaining display grayscales of the 800*600 pixels in the current frame of image.

Calculating the average of grayscales of the at least one display zone in the current frame of image from the display grayscales of the respective pixels in the display zone.

For example, a display zone includes 48 pixels, and the average of grayscales of the 48 pixels in the display zone is calculated from display grayscales of the 48 pixels.

Optionally the obtaining the average of grayscales of the at least one display zone in the previous frame of image includes:

Calculating the averages of grayscales of the respective display zones in the current frame of image from the display grayscales of the respective pixels in the respective display zones.

For example, the display panel includes 800*600 pixels divided into 10,000 display zones, that is, each display zone includes 48 pixels. The averages of grayscales of the respective display zones in the current frame of image are calculated from the display grayscales of the respective pixels in the respective display zones by calculating averages of grayscales of the 10,000 display zones.

Obtaining the averages of grayscales of the respective display zones in the current frame of image.

That is, the averages of grayscales of the 10,000 display zones calculated above.

The obtaining the average of grayscales of the at least one display zone in the previous frame of image includes:

Obtaining the averages of grayscales of the respective display zones in the previous frame of image. Particularly the averages of grayscales of the respective display zones in the previous frame of image can be obtained by obtaining the pre-stored averages of grayscales of the respective display zones in the previous frame of image.

The comparing the average of grayscales of at least one display zone in the current frame with the average of grayscales of the corresponding display zone in the previous frame includes:

Comparing the averages of grayscales of the respective display zones in the current frame with the averages of grayscales of the respective display zones in the previous frame.

That is, the averages of grayscales of the respective display zones in the current frame of image can be obtained, the pre-stored averages of grayscales of the respective display zones in the previous frame of image can be obtained, the averages of grayscales of the respective display zones in the current frame of image can be compared with the averages of grayscales of the respective display zones in the previous frame of image, and the backlight control values to increase or reduce the brightness of the illuminating elements corresponding to the respective display zones in the current frame of image can be determined and output.

Optionally, the calculating the average of grayscales of the at least one display zone in the current frame of image from the display grayscales of the respective pixels in the display zone includes:

Calculating the averages of grayscales of the respective display zones in the current frame of image from the display grayscales of the respective pixels in the respective display zones.

For details thereof, reference can be made to the calculating the averages of grayscales of the respective display zones in the current frame of image from the display grayscales of the respective pixels in the respective display zones above, and a repeated description thereof will be omitted here.

Obtaining a first display zone to be adjusted corresponding to the average of grayscales below a first threshold of grayscale and/or above a second threshold of grayscale.

Where the second threshold is larger than the first threshold, for example, the first threshold is 32, and the second threshold is 200, and where the values of the first threshold and the second threshold are preset according to a characteristic parameter and a design need of the liquid crystal panel.

The first display zone to be adjusted corresponding to the average of grayscales below the first threshold of grayscale and/or above the second threshold of grayscale can be obtained, for example, by obtaining only the first display zone to be adjusted corresponding to the average of grayscales smaller than a grayscale of 32; or can be obtained by obtaining only the first display zone to be adjusted corresponding to the average of grayscales larger than a grayscale of 200; or can be obtained by obtaining the first display zones to be adjusted corresponding to the average of grayscales smaller than a grayscale of 32 and larger than a grayscale of 200.

Of course, alternatively the first display zone to be adjusted corresponding to the average of grayscales smaller than a grayscale of 20 and/or larger than a grayscale of 220 can be obtained. Since over drive may result in an insignificant influence upon a pixel at a too low grayscale or a too high grayscale, preferably the pixels at a low grayscale and a high grayscale are adjusted in some embodiments, but a particular grayscale value(s) can be preset particularly for the display, and in some embodiments, a detailed description has been given only taking as the first display zone to be adjusted corresponding to the average of grayscales below a grayscale of 32 and/or a grayscale of 200.

The obtaining the average of grayscales of the at least one display zone in the previous frame of image includes:

Obtaining the average of grayscales of the first display zone to be adjusted in the previous frame of image.

Of course, alternatively the averages of grayscales of the respective display zones in the previous frame of image can be obtained, but when the first display zone to be adjusted in the current frame is obtained, the average of grayscales of the at least one display zone in the current frame can be compared in magnitude with the average of grayscales of the corresponding display zone in the previous frame of image by comparing only the average of grayscales corresponding to the first display zone to be adjusted in the current frame with the average of grayscales corresponding to the first display zone to be adjusted in the previous frame, and the backlight control value to increase or reduce the brightness of the illuminating element corresponding to the first display zone to be adjusted in the current frame is output.

The comparing in magnitude the average of grayscales of the at least one display zone in the current frame with the average of grayscales of the corresponding display zone in the previous frame of image includes:

Comparing the average of grayscales of the first display zone to be adjusted in the current frame with the average of grayscales of the corresponding display zone in the previous frame.

That is, the average of grayscales of the first display zone to be adjusted in the current frame of image is obtained, and the pre-stored average of grayscales of the first display zone to be adjusted in the previous frame of image can be obtained, and the average of grayscales of the first display zone to be adjusted in the current frame is compared with the average of grayscales of the corresponding display zone in the previous frame, and the backlight control value to increase or reduce the brightness of the illuminating element corresponding to the first display zone to be adjusted in the current frame of image is determined and output.

Optionally, before calculating the averages of grayscales of the respective display zones in the current frame of image from the display grayscales of the respective pixels in the respective display zones, the one or more processors 102 further execute the computer readable program codes to implement:

Determining pixels with display grayscales in the current frame of image outside a display grayscale interval according to the display grayscales of the respective pixels in the current frame of image and the display grayscale interval.

Particularly the display grayscale interval can be grayscales of 32 to 200, and pixels with display grayscales other than the grayscales of 32 to 200 among the 800*600 pixels in the current frame of image are determined according to the display grayscales of the 800*600 pixels in the current frame of image.

Of course the display grayscale interval can alternatively be grayscales 20 to 220 or the like and can be adjusted differently for the particular display device, and in some embodiments, a detailed description has been given only taking the display grayscale interval being grayscales of 32 to 200 as an example.

Determining a second display zone to be adjusted in which all the pixels with the display grayscales in the current frame of image outside the display grayscale interval are located.

That is, all the display grayscales of the respective pixels in the second display zone to be adjusted are in the display grayscale interval. Optionally the display grayscales in the display grayscale interval are grayscales of 32 to 200.

The calculating the average of grayscales of the at least one display zone in the current frame of image from the display grayscales of the respective pixels in the display zone includes:

Calculating the average of grayscales of the second display zone to be adjusted in the current frame of image from the display grayscales of the respective pixels in the second display zone to be adjusted.

The obtaining the average of grayscales of the at least one display zone in the previous frame of image includes:

Obtaining the average of grayscales of the second display zone to be adjusted in the previous frame of image.

Of course, alternatively the averages of grayscales of the respective display zones in the previous frame of image can be obtained, but when the second display zone to be adjusted in the current frame is obtained, the average of grayscales of the at least one display zone in the current frame can be compared in magnitude with the average of grayscales of the corresponding display zone in the previous frame of image by comparing only the average of grayscales corresponding to the second display zone to be adjusted in the current frame with the average of grayscales corresponding to the second display zone to be adjusted in the previous frame, and the backlight control value to increase or reduce the brightness of the illuminating element corresponding to the second display zone to be adjusted in the current frame is output.

The comparing in magnitude the average of grayscales of the at least one display zone in the current frame with the average of grayscales of the corresponding display zone in the previous frame of image includes:

Comparing the average of grayscales of the second display zone to be adjusted in the current frame with the average of grayscales of the corresponding display zone in the previous frame.

That is, the average of grayscales of the second display zone to be adjusted in the current frame of image is obtained, and the pre-stored average of grayscales of the second display zone to be adjusted in the previous frame of image can be obtained, and the average of grayscales of the second display zone to be adjusted in the current frame is compared with the average of grayscales of the corresponding display zone in the previous frame, and the backlight control value to increase or reduce the brightness of the illuminating element corresponding to the second display zone to be adjusted in the current frame of image is determined and output.

Optionally, the one or more processors 102 further execute the computer readable program codes to implement:

Performing over drive on all the display grayscales of the respective pixels in the current frame of image or a part thereof in the display grayscale interval according to the display grayscales of the respective pixels in the current frame of image.

It shall be noted that the one or more processors 102 can be integrated into a video processing chip or can be integrated in an integrated chip of the timing controller or can be a separate integrated chip separately without any limitation thereto.

Over drive can be performed on all or a part of the respective pixels in the current frame of image by performing over drive on all the respective pixels in the current frame of image or by performing over drive on a part of the respective pixels in the current frame of image, where the part of the respective pixels can be preset pixels.

Particularly, over drive performed on all or a part of the pixels in the current frame of image can be performed as in an existing output processing method of over drive, and a repeated description thereof will be omitted here.

Optionally, the outputting the backlight control value to increase the brightness of the illuminating element corresponding to the display zone, and the outputting a backlight control value to reduce the brightness of the illuminating element corresponding to the display zone includes:

Searching, with the average of grayscales of the corresponding display zone in the previous frame of image and the average of grayscales of the display zone in the current frame of image, a search table for the value of a duty ratio or the value of a current of the illuminating element corresponding to the display zone in the current frame of image;

Outputting the value of the duty ratio or the value of the current.

Particularly as illustrated in FIG. 8, a first search table is searched, with the average of grayscales of the display zone in the current frame of image and the average of grayscales of the corresponding display zone in the previous frame of image, for the value of the duty ratio corresponding to the display zone to be output, i.e., the value of the duty ratio to increase or reduce the driving signal of the illuminating element corresponding to the display zone to be output. For example, with the average 8 of grayscales of the display zone in the current frame of image and the average 16 of grayscales of the corresponding display zone in the previous frame of image, the first search table is searched for the value 18% of the duty ratio corresponding to the display zone to be output. That is, when the average of grayscales of the at least one display zone in the current frame of image of image is smaller than the average of grayscales of the corresponding display zone in the previous frame of image, then the value of the duty ratio to reduce the driving signal of the illuminating element corresponding to the display zone is output to reduce the brightness of the illuminating element corresponding to the display zone.

It shall be noted that in the first search table illustrated in FIG. 8, a duty ratio 20% of the illuminating element of the display device is taken as an example, where the duty ratio of the illuminating element is normally 20%. If the average of grayscales of the display zone in the current frame of image is equal to the average of grayscales of the corresponding display zone in the previous frame of image, then the brightness of the illuminating element of the display zone in the current frame of image will not be adjusted, and at this time, the duty ratio of the illuminating element is 20%.

Particularly as illustrated in FIG. 9, a second search table is searched, with the average of grayscales of some display zone in the current frame of image and the average of grayscales of the corresponding display zone in the previous frame of image, for the value of the current corresponding to the display zone to be output, i.e., the value of the current to increase or reduce the driving signal of the illuminating element corresponding to the display zone to be output. For example, with the average 8 of grayscales of the display zone in the current frame of image and the average 16 of grayscales of the corresponding display zone in the previous frame of image, the second search table is searched for the value 295 mA of the current corresponding to the display zone to be output. That is, when the average of grayscales of the at least one display zone in the current frame of image of image is smaller than the average of grayscales of the corresponding display zone in the previous frame of image, then the value of the current to reduce the driving signal of the illuminating element corresponding to the display zone is output to reduce the brightness of the illuminating element corresponding to the display zone.

It shall be noted that in the second search table illustrated in FIG. 9, the current 300 mA of the illuminating element of the display device is taken as an example, where the current of the illuminating element is normally 300 mA. If the average of grayscales of the display zone in the current frame of image is equal to the average of grayscales of the corresponding display zone in the previous frame of image, then the brightness of the illuminating element of the display zone in the current frame of image will not be adjusted, and at this time, the current of the illuminating element is 300 mA.

It shall be noted that FIG. 8 and FIG. 9 illustrate 8-bit mapping, and of course 10-bit or 12-bit mapping or the like is also possible, and in some embodiments, a detailed description has been given only taking 8-bit mapping as an example.

Figure 14:
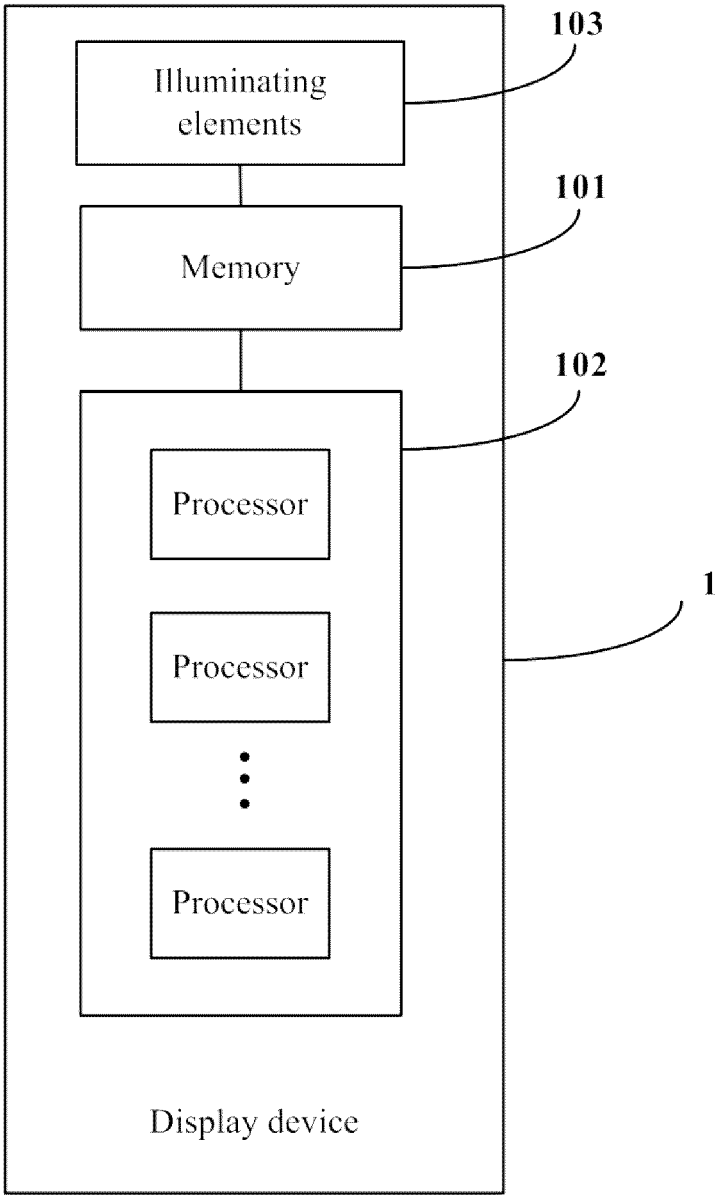
FIG. 14 is a schematic diagram of a display device according to some embodiments.

Some embodiments provides a display device which can be a liquid crystal display or other display devices and a TV set, a digital camera, a handset, a tablet PC or any other product or component, with a display function, including these display devices. As illustrated in FIG. 14, some embodiments provides a display device 1, including illuminating elements 103, a memory 101; and one or more processors 102, wherein: the memory 101 is configured to store computer readable program codes, and the one or more processors 102 execute the computer readable program codes to implement:

Obtaining the average of grayscales of at least one display zone in a previous frame of image and the average of grayscales of at least one display zone in a current frame of image, wherein a frame of image is divided into a plurality of display zones, and each one of the plurality of display zones includes at least one pixel; and wherein the previous frame of image and the current frame of image are a left-eye image and a right-eye image respectively;

Comparing in magnitude the average of grayscales of at least one display zone in the current frame of image with the average of grayscales of the corresponding display zone in the previous frame of image; and Outputting a backlight control value to increase the brightness of an illuminating element corresponding to the display zone when the average of grayscales of the at least one display zone in the current frame of image is larger than the average of grayscales of the corresponding display zone in the previous frame of image, and outputting a backlight control value to reduce the brightness of the illuminating element corresponding to the display zone when the average of grayscales of the at least one display zone in the current frame of image is smaller than the average of grayscales of the corresponding display zone in the previous frame of image.

Where the obtaining the average of grayscales of the at least one display zone in the current frame of image includes:

Obtaining display grayscales of respective pixels in the current frame of image; and Calculating the average of grayscales of the at least one display zone in the current frame of image from the display grayscales of the respective pixels in the display zone.

Where the outputting the backlight control value to increase the brightness of the illuminating element corresponding to the display zone includes:

Outputting the value of a duty ratio or the value of a current to increase the driving signal of the illuminating element corresponding to the display zone; and The outputting the backlight control value to reduce the brightness of the illuminating element corresponding to the display zone includes:

Outputting the value of the duty ratio or the value of the current to reduce the driving signal of the illuminating element corresponding to the display zone.

Some embodiments provides another structure of the display device 1, and as illustrated in FIG. 15, the display device 1 includes a liquid crystal panel 60, a backlight component 30 composed of a plurality of illuminating elements, a time controller 40, a backlight drive circuit 50 and the apparatus 100 for processing a display signal, where the apparatus 100 for processing a display signal receives an image signal, and a branch of the display signal is scaled and then output to the timing controller 40, and the timing controller 40 generates from a received image signal of the apparatus 100 for processing a display signal a control signal to drive the liquid crystal panel 60, which includes a data signal to control the angle at which liquid crystal molecules of the liquid crystal panel 60 are deflected and a gate signal to control a Thin Film Transistor (TFT) of the liquid crystal panel 60; and the other branch of the display signal is processed to generate and output a backlight control signal to the backlight drive circuit 50 to thereby control the backlight component so as to provide bright rays to display an image.

Although the certain embodiments of the application have been described, those skilled in the art benefiting from the underlying inventive concept can make additional modifications and variations to these embodiments. Therefore the appended claims are intended to be construed as encompassing certain disclosed embodiments and all the modifications and variations coming into the scope of the application.

Evidently those skilled in the art can make various modifications and variations to the application without departing from the spirit and scope of the application. Thus the application is also intended to encompass these modifications and variations thereto.

What is claimed is:

1. A method of processing a display signal, wherein the method is applicable to a 3-dimensional (3D) display device, and the method comprises:

obtaining the average of grayscales of at least one display zone in a previous frame of image and the average of grayscales of at least one display zone in a current frame of image, wherein a frame of image is divided into a plurality of display zones, and each one of the plurality of display zones includes at least one pixel; and wherein the previous frame of image and the current frame of image are a left-eye image and a right-eye image respectively;

comparing in magnitude the average of grayscales of at least one display zone in the current frame of image with the average of grayscales of the corresponding display zone in the previous frame of image; and outputting a backlight control value to increase the brightness of an illuminating element corresponding to the display zone when the average of grayscales of the at least one display zone in the current frame of image is larger than the average of grayscales of the corresponding display zone in the previous frame of image, and outputting a backlight control value to reduce the brightness of the illuminating element corresponding to the display zone when the average of grayscales of the at least one display zone in the current frame of image is smaller than the average of grayscales of the corresponding display zone in the previous frame of image.

2. The method of processing the display signal of claim 1, wherein the obtaining the average of grayscales of the at least one display zone in the current frame of image comprises:

obtaining display grayscales of respective pixels in the current frame of image; and obtaining the average of grayscales of the at least one display zone in the current frame of image according to the display grayscales of the respective pixels in the display zone.

3. The method of processing the display signal of claim 2, wherein the obtaining the average of grayscales of the at least one display zone in the current frame of image according to the display grayscales of the respective pixels in the display zone comprises:

obtaining the averages of grayscales of the respective display zones in the current frame of image according to the display grayscales of the respective pixels in the respective display zones, and obtaining the averages of grayscales of the respective display zones in the current frame of image;

the obtaining the average of grayscales of the at least one display zone in the previous frame of image comprises:

obtaining the averages of grayscales of the respective display zones in the previous frame of image; and the comparing the average of grayscales of at least one display zone in the current frame with the average of grayscales of the corresponding display zone in the previous frame comprises:

comparing the averages of grayscales of the respective display zones in the current frame with the averages of grayscales of the respective display zones in the previous frame.

4. The method of processing the display signal of claim 2, wherein the obtaining the average of grayscales of the at least one display zone in the current frame of image according to the display grayscales of the respective pixels in the display zone comprises:

obtaining the averages of grayscales of the respective display zones in the current frame of image according to the display grayscales of the respective pixels in the respective display zones, and obtaining a first display zone to be adjusted corresponding to the average of grayscales below a first threshold of grayscale and/or above a second threshold of grayscale, wherein the second threshold is larger than the first threshold;

the obtaining the average of grayscales of the at least one display zone in the previous frame of image comprises:

obtaining the average of grayscales of the first display zone to be adjusted in the previous frame of image; and the comparing in magnitude the average of grayscales of the at least one display zone in the current frame with the average of grayscales of the corresponding display zone in the previous frame of image comprises:

comparing the average of grayscales of the first display zone to be adjusted in the current frame with the average of grayscales of the corresponding display zone in the previous frame.

5. The method of processing the display signal of claim 2, wherein before obtaining the averages of grayscales of the respective display zones in the current frame of image according to the display grayscales of the respective pixels in the respective display zones, the method further comprises:

determining pixels with display grayscales in the current frame of image outside a display grayscale interval according to the display grayscales of the respective pixels in the current frame of image and the display grayscale interval, and determining a second display zone to be adjusted in which all the pixels with the display grayscales in the current frame of image outside the display grayscale interval are located;

the obtaining the average of grayscales of the at least one display zone in the current frame of image according to the display grayscales of the respective pixels in the display zone comprises:

obtaining the average of grayscales of the second display zone to be adjusted in the current frame of image according to the display grayscales of the respective pixels in the second display zone to be adjusted;

the obtaining the average of grayscales of the at least one display zone in the previous frame of image comprises:

obtaining the average of grayscales of the second display zone to be adjusted in the previous frame of image; and the comparing in magnitude the average of grayscales of the at least one display zone in the current frame with the average of grayscales of the corresponding display zone in the previous frame of image comprises:

comparing the average of grayscales of the second display zone to be adjusted in the current frame with the average of grayscales of the corresponding display zone in the previous frame.

6. The method of processing the display signal of claim 5, wherein the display grayscales in the display grayscale are grayscales of 32 to 200.

7. The method of processing the display signal of claim 2, wherein after the display grayscales of the respective pixels in the current frame of image are obtained, the method comprises: performing over drive data processing on all the display grayscales of the respective pixels in the current frame of image or a part thereof in a display grayscale interval according to the display grayscales of the respective pixels in the current frame of image.

8. The method of processing the display signal according to claim 7, wherein the display grayscales in the display grayscale are grayscales of 32 to 200.

9. The method of processing the display signal of claim 1, wherein the outputting the backlight control value to increase the brightness of the illuminating element corresponding to the display zone comprises:

outputting the value of a duty ratio or the value of a current to increase the driving signal of the illuminating element corresponding to the display zone; and the outputting the backlight control value to reduce the brightness of the illuminating element corresponding to the display zone comprises:

outputting the value of the duty ratio or the value of the current to reduce the driving signal of the illuminating element corresponding to the display zone.

10. The method of processing the display signal of claim 9, wherein the outputting the value of the duty ratio or the value of the current to increase the driving signal of the illuminating element corresponding to the display zone, and the outputting the value of the duty ratio or the value of the current to reduce the driving signal of the illuminating element corresponding to the display zone comprises:

searching, with the average of grayscales of the corresponding display zone in the previous frame of image and the average of grayscales of the display zone in the current frame of image, a search table for the value of the duty ratio or the value of the current of the illuminating element corresponding to the display zone in the current frame of image; and outputting the value of the duty ratio or the value of the current.

11. An apparatus for processing a display signal, wherein the apparatus for processing the display signal is applicable to a 3-dimensional (3D) display device, comprising:

a memory; and one or more processors, wherein:

the memory is configured to store computer readable program codes, and the one or more processors execute the computer readable program codes to implement:

obtaining the average of grayscales of at least one display zone in a previous frame of image;

obtaining the average of grayscales of at least one display zone in a current frame of image, wherein a frame of image is divided into a plurality of display zones, and each one of the display zones includes at least one pixel; and wherein the previous frame of image and the current frame of image are a left-eye image and a right-eye image respectively;

comparing in magnitude the average of grayscales of at least one display zone in the current frame of image with the average of grayscales of the corresponding display zone in the previous frame of image; and outputting a backlight control value to increase the brightness of an illuminating element corresponding to the display zone when the average of grayscales of the at least one display zone in the current frame of image is larger than the average of grayscales of the corresponding display zone in the previous frame of image and to output a backlight control value to reduce the brightness of the illuminating element corresponding to the display zone when the average of grayscales of the at least one display zone in the current frame of image is smaller than the average of grayscales of the corresponding display zone in the previous frame of image.

12. The apparatus for processing the display signal of claim 11, wherein the obtaining the average of grayscales of the at least one display zone in the current frame of image comprises:

obtaining display grayscales of respective pixels in the current frame of image; and obtaining the average of grayscales of the at least one display zone in the current frame of image according to the display grayscales of the respective pixels in the display zone.

13. The apparatus for processing the display signal of claim 12, wherein the obtaining the average of grayscales of the at least one display zone in the current frame of image according to the display grayscales of the respective pixels in the display zone comprises:

obtaining the averages of grayscales of the respective display zones in the current frame of image according to the display grayscales of the respective pixels in the respective display zones, and obtaining the averages of grayscales of the respective display zones in the current frame of image;

the obtaining the average of grayscales of the at least one display zone in the previous frame of image comprises:

obtaining the averages of grayscales of the respective display zones in the previous frame of image; and the comparing the average of grayscales of at least one display zone in the current frame with the average of grayscales of the corresponding display zone in the previous frame comprises:

comparing the averages of grayscales of the respective display zones in the current frame with the averages of grayscales of the respective display zones in the previous frame.

14. The apparatus for processing the display signal of claim 12, wherein the obtaining the average of grayscales of the at least one display zone in the current frame of image according to the display grayscales of the respective pixels in the display zone comprises:

obtaining the averages of grayscales of the respective display zones in the current frame of image according to the display grayscales of the respective pixels in the respective display zones, and obtaining a first display zone to be adjusted corresponding to the average of grayscales below a first threshold of grayscale and/or above a second threshold of grayscale, wherein the second threshold is larger than the first threshold;

the obtaining the average of grayscales of the at least one display zone in the previous frame of image comprises:

obtaining the average of grayscales of the first display zone to be adjusted in the previous frame of image; and the comparing in magnitude the average of grayscales of the at least one display zone in the current frame with the average of grayscales of the corresponding display zone in the previous frame of image comprises:

comparing the average of grayscales of the first display zone to be adjusted in the current frame with the average of grayscales of the corresponding display zone in the previous frame.

15. The apparatus for processing the display signal of claim 12, before obtaining the averages of grayscales of the respective display zones in the current frame of image according to the display grayscales of the respective pixels in the respective display zones, the one or more processors further execute the computer readable program codes to implement:

determining pixels with display grayscales in the current frame of image outside a display grayscale interval according to the display grayscales of the respective pixels in the current frame of image and the display grayscale interval, and determining a second display zone to be adjusted in which all the pixels with the display grayscales in the current frame of image outside the display grayscale interval are located;

the obtaining the average of grayscales of the at least one display zone in the current frame of image according to the display grayscales of the respective pixels in the display zone comprises:

obtaining the average of grayscales of the second display zone to be adjusted in the current frame of image according to the display grayscales of the respective pixels in the second display zone to be adjusted;

the obtaining the average of grayscales of the at least one display zone in the previous frame of image comprises:

obtaining the average of grayscales of the second display zone to be adjusted in the previous frame of image; and the comparing in magnitude the average of grayscales of the at least one display zone in the current frame with the average of grayscales of the corresponding display zone in the previous frame of image comprises:

comparing the average of grayscales of the second display zone to be adjusted in the current frame with the average of grayscales of the corresponding display zone in the previous frame.

16. The apparatus for processing the display signal of claim 12, wherein the one or more processors further execute the computer readable program codes to implement:

performing over drive on all the display grayscales of the respective pixels in the current frame of image or a part thereof in a display grayscale interval according to the display grayscales of the respective pixels in the current frame of image.

17. The apparatus for processing the display signal of claim 11, wherein the outputting the backlight control value to increase the brightness of the illuminating element corresponding to the display zone, and the outputting a backlight control value to reduce the brightness of the illuminating element corresponding to the display zone comprises:

searching, with the average of grayscales of the corresponding display zone in the previous frame of image and the average of grayscales of the display zone in the current frame of image, a search table for the value of a duty ratio or the value of a current of the illuminating element corresponding to the display zone in the current frame of image; and outputting the value of the duty ratio or the value of the current.

18. A display device, comprising illuminating elements, a memory; and one or more processors, wherein:

the memory is configured to store computer readable program codes, and the one or more processors execute the computer readable program codes to implement:

obtaining the average of grayscales of at least one display zone in a previous frame of image and the average of grayscales of at least one display zone in a current frame of image, wherein a frame of image is divided into a plurality of display zones, and each one of the plurality of display zones includes at least one pixel; and wherein the previous frame of image and the current frame of image are a left-eye image and a right-eye image respectively;

comparing in magnitude the average of grayscales of at least one display zone in the current frame of image with the average of grayscales of the corresponding display zone in the previous frame of image; and outputting a backlight control value to increase the brightness of an illuminating element corresponding to the display zone when the average of grayscales of the at least one display zone in the current frame of image is larger than the average of grayscales of the corresponding display zone in the previous frame of image, and outputting a backlight control value to reduce the brightness of the illuminating element corresponding to the display zone when the average of grayscales of the at least one display zone in the current frame of image is smaller than the average of grayscales of the corresponding display zone in the previous frame of image.

19. The display device of claim 18, wherein the obtaining the average of grayscales of the at least one display zone in the current frame of image comprises:

obtaining display grayscales of respective pixels in the current frame of image; and obtaining the average of grayscales of the at least one display zone in the current frame of image according to the display grayscales of the respective pixels in the display zone.

20. The display device of claim 18, wherein the outputting the backlight control value to increase the brightness of the illuminating element corresponding to the display zone comprises:

outputting the value of a duty ratio or the value of a current to increase the driving signal of the illuminating element corresponding to the display zone; and the outputting the backlight control value to reduce the brightness of the illuminating element corresponding to the display zone comprises:

outputting the value of the duty ratio or the value of the current to reduce the driving signal of the illuminating element corresponding to the display zone.

* * * * *